US006904628B2

(12) United States Patent
Murphy et al.

(10) Patent No.: US 6,904,628 B2
(45) Date of Patent: Jun. 14, 2005

(54) CONVERTIBLE SOFA-BED

(75) Inventors: Marcus L. Murphy, Lexington, NC (US); Douglas Gasal, Dallas, TX (US); Robert B. Duncan, Irving, TX (US); H. Robert Tiffany, Point Pleasant, PA (US)

(73) Assignee: American Leather, Dallas, TX (US)

( * ) Notice: Subject to any disclaimer, the term of this patent is extended or adjusted under 35 U.S.C. 154(b) by 89 days.

(21) Appl. No.: 10/172,421

(22) Filed: Jun. 13, 2002

(65) Prior Publication Data

US 2003/0070225 A1 Apr. 17, 2003

Related U.S. Application Data

(60) Provisional application No. 60/329,021, filed on Oct. 12, 2001.

(51) Int. Cl.[7] ..... A47C 17/17
(52) U.S. Cl. ..... 5/47; 5/42
(58) Field of Search ..... 5/13, 14, 24, 25, 5/26.1, 28, 29, 35, 30, 31, 32.1, 33, 34

(56) References Cited

U.S. PATENT DOCUMENTS 2,664,145 A * 12/1953 Craveling et al. ..... 5/36
2,671,228 A * 3/1954 De Maria ..... 5/41
2,876,461 A * 3/1959 Bontempi ..... 5/13
3,085,257 A * 4/1963 Laemmie ..... 5/29
3,145,049 A * 8/1964 Duke ..... 297/105
3,178,731 A * 4/1965 Pokorny ..... 5/13
3,456,268 A * 7/1969 Rodgers, Jr. ..... 5/17
3,506,984 A * 4/1970 Ellis, Jr. et al. ..... 5/29
3,771,178 A * 11/1973 Inman ..... 5/13
3,864,764 A * 2/1975 Janusc ..... 5/29
3,908,210 A * 9/1975 Alembik ..... 5/29
4,032,999 A * 7/1977 Pringle ..... 5/14
4,694,514 A * 9/1987 Crossett ..... 5/12.1
4,737,996 A 4/1988 Tiffany
5,904,401 A * 5/1999 Alberda et al. ..... 297/354.13

OTHER PUBLICATIONS

Cover of *Highpoints* publication, Tiffany Sleeper, Market Introductions (Apr. 2000).
Cover of *The Philadelphia Inquirer*, Home and Design Section (Apr. 21, 2000).
*UDM Design News*, p. 32 (Jun. 2000).
Home & Garden, *Sun–Sentinel*, p. 3E (South Florida, Apr. 14, 2000).
*Functional upholstery takes center stage, Furniture Today*, vol. 24, No. 30d, 2 pages (Apr. 9, 2000).
Photograph 1, Version 1, sofa shown at trade show in San Francisco, folding center leg and Version 1 front leg actuator (Jan. 2000).
Photograph 2, Version 1, sofa shown at trade show in San Francisco, sofa partially opened (Jan. 2000).
Photograph 3, Version 1, sofa shown at trade show in San Francisco, sofa completely opened (Jan. 2000).
Photograph 4, Version 1, sofa shown at trade show in San Francisco, tube assembly front pivot offset and extended and folding center leg extended (Jan. 2000).

(Continued)

*Primary Examiner*—Michael Safavi
(74) *Attorney, Agent, or Firm*—Myers Bigel Sibley & Sajovec

(57) ABSTRACT

A sofa-bed has: a frame with opposing arms; a seat; a subseat hinged to the seat; a connecting rod that pivotally interconnects the subseat and the backrest; pairs of center legs and end legs pivotally attached to, respectively, the subseat and seat; and mechanisms for folding and unfolding the center and end legs. The sofa-bed is movable between a folded position and an unfolded position. The mechanisms for the center legs and the end legs are configured to move the legs from a generally horizontal folded position between the seat and subseat when the sofa-bed is in the folded position to a generally upright position beneath, respectively, the subseat and seat when the bed is in the unfolded position.

34 Claims, 23 Drawing Sheets

OTHER PUBLICATIONS

Photograph 5, Version 1, sofa shown at trade show in San Francisco, folding center leg extended and front wood leg with Version 1 of front leg actuator (Jan. 2000).

Photograph 6, Version 2, sofa shown at trade show in High Point, folding center leg extended and metal tube front leg with version 2 of front leg actuator (Apr. 2000).

Photograph 7, Version 2, sofa shown at trade show in High Point, metal tube front leg with Version 2 of front leg actuator and folding center leg extended (Apr. 2000).

Photograph 8, Version 2, sofa shown at trade show in High Point, metal tube front leg with Version 2 of from leg actuator and folding center leg extended (Apr. 2000).

Photograph 9, Versions 1 and 2, tube assembly front pivot (offset & extended).

Photograph 10, Versions 1 and 2, inside arm spring assist.

Photograph 11, Versions 1 and 2, inside arm spring assist.

Photograph 12, Versions 1 and 2, inside arm spring assist.

* cited by examiner

CONVERTIBLE SOFA-BED

This application claims the benefit of provisional application 60/329,021 filed on Oct. 12, 2001.

FIELD OF THE INVENTION

The present invention relates generally to a sofa that is convertible into a bed, and relates more specifically to a sofa that has backrest and seat sections that form portions of the bed.

BACKGROUND OF THE INVENTION

Convertible sofa beds are popular with consumers because of their multifunctionality. Many consumers find it very convenient to have a sofa that can provide a bed for a guest, as such a sofa can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other sofa beds lack a complete mattress, instead being constructed of separate sections that serve as support surfaces of the sofa and unfold to form a flat, mattress-like sleeping surface. An example of a convertible sofa of this type is illustrated in U.S. Pat. No. 4,737,996 to Tiffany. The Tiffany sofa-bed includes a backrest, a seat and a "subseat" that unfold to form the horizontal sleeping surface. In the folded "sofa" configuration, the backrest is generally upright, and the seat and "subseat" fold upon each other (with the subseat in an inverted position). The backrest is guided between positions by preformed slots in the arms of the sofa that receive posts that extend laterally from the backrest. The backrest is coupled to the seat and subseat via an angled link. The subseat is pivotally attached at one end to the arms and is hinged at the other end to the seat. This arrangement is described in Tiffany as being particularly economical and having relatively few moving parts. It would be desirable to provide an improved version of this configuration (particularly one that provides a bed at a "standard" height of between about 18 and 26 inches) to capitalize on these advantages.

In addition, the Tiffany-style sofa-bed employs the backrest of the sofa-bed as the head end of the unfolded bed. Because the backrest section is required to pivot when moving between positions, it is not fixed to the arms of the sofa. As such, there are typically small gaps between the outer edges of the backrest and the arms that can be unsightly. It would be desirable to provide a Tiffany-style sofa-bed that lacks these gaps between the backrest and the arms.

Moreover, the Tiffany-style sofa employs sections of cushions and panels that can be rather heavy and, therefore, difficult to move between positions. It would be desirable to provide a Tiffany-style sofa-bed that moves easily between the unfolded and folded positions.

SUMMARY OF THE INVENTION

The present invention is directed to a sofa-bed having a movable backrest, seat and subseat that can unfold to form a bed of conventional bed height. The sofa-bed comprises: a frame with opposing arms, a backrest operatively connected with the frame such that the backrest can pivot and slide relative to the frame; a seat; a subseat hinged to the seat; a connecting rod that pivotally interconnects the subseat and the backrest; pairs of center legs and end legs pivotally attached to, respectively, the subseat and seat; and mechanisms for folding and unfolding the center and end legs. The sofa-bed is movable between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation. The mechanisms for the center legs and the end legs are configured to move the legs from a generally horizontal folded position between the seat and subseat when the sofa-bed is in the folded position to a generally upright position beneath, respectively, the subseat and seat when the bed is in the unfolded position. In this configuration, the sofa-bed, when unfolded, can provide a bed of conventional height.

The sofa-bed of the present invention may optionally include, in some embodiments, a balance mechanism that assists the user in folding and unfolding the sofa-bed. In one embodiment, the balance mechanism is attached to the subseat and the arm and includes a spring that can supply tension to the mechanism such that the both unfolding and folding are facilitated.

The sofa-bed of the present invention may also include, in other embodiments, a back panel that is fixed to and extends between the arms. In these embodiments, the backrest, seat and subseat move and are connected in the manner described above. In certain embodiments, the back panel includes a recess within which the backrest nests in the folded position.

DETAILED DESCRIPTION OF THE INVENTION

The present invention will be described more particularly hereinafter with reference to the accompanying drawings. The invention is not intended to be limited to the illustrated embodiments; rather, these embodiments are intended to fully and completely disclose the invention to those skilled in this art. Like numbers refer to like components throughout, and certain dimensions and thicknesses may be exaggerated for clarity.

Figure 1:
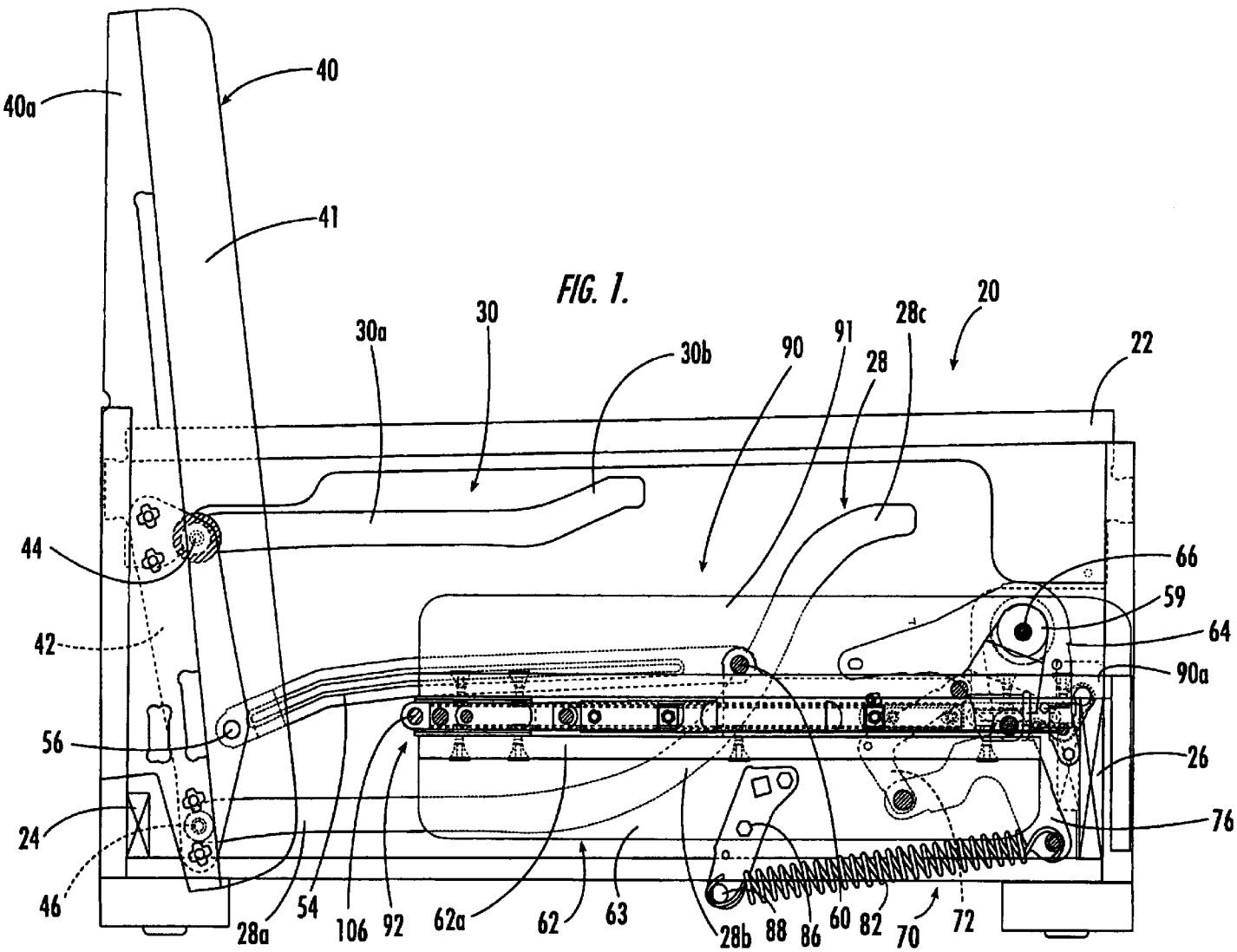
FIG. 1 is a cutaway side view of the sofa-bed of the present invention shown in its folded position.
Figure 2:
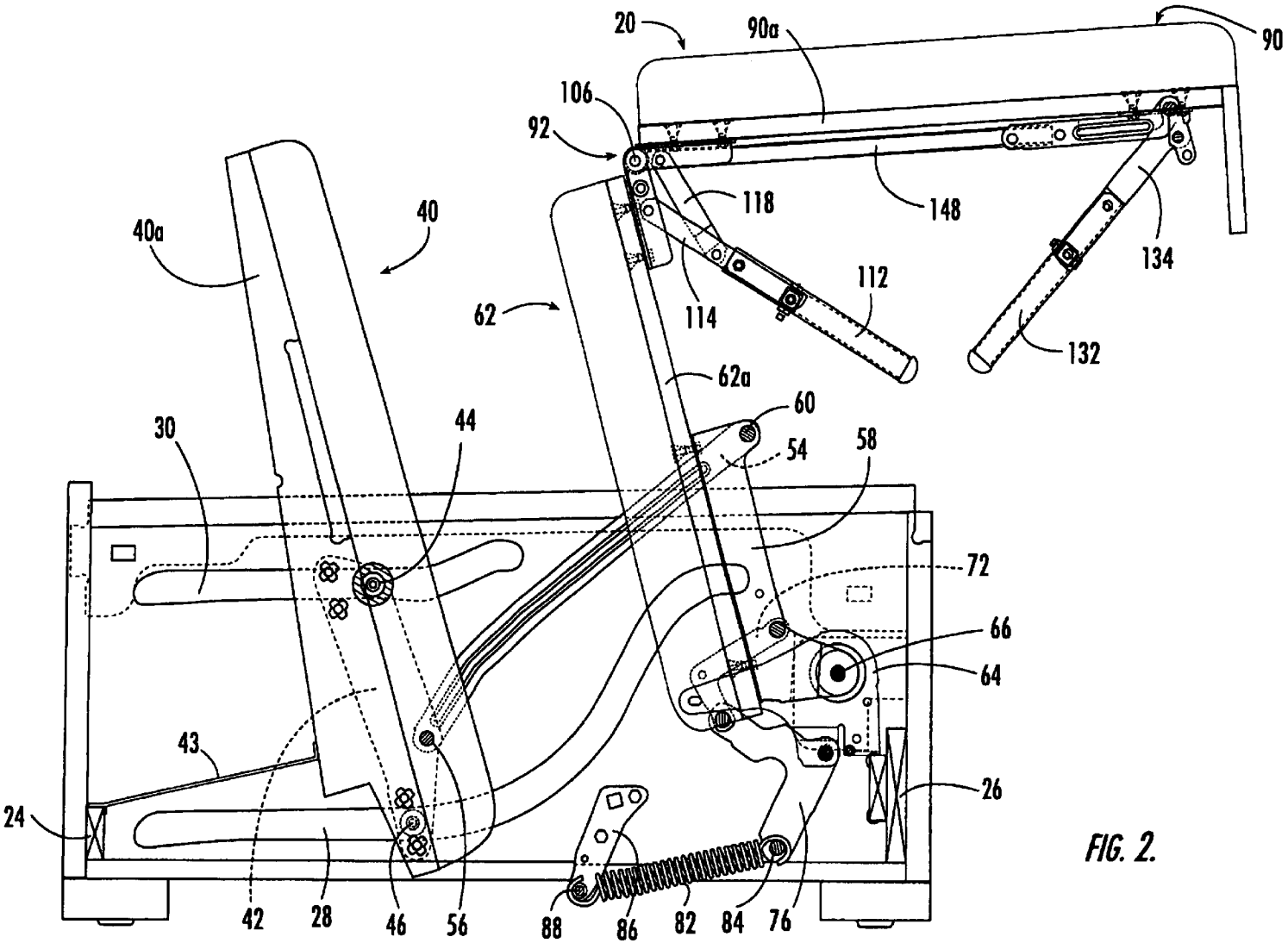
FIG. 2 is a cutaway side view of the sofa-bed of FIG. 1 shown in an intermediate position between the folded and unfolded positions.
Figure 3:
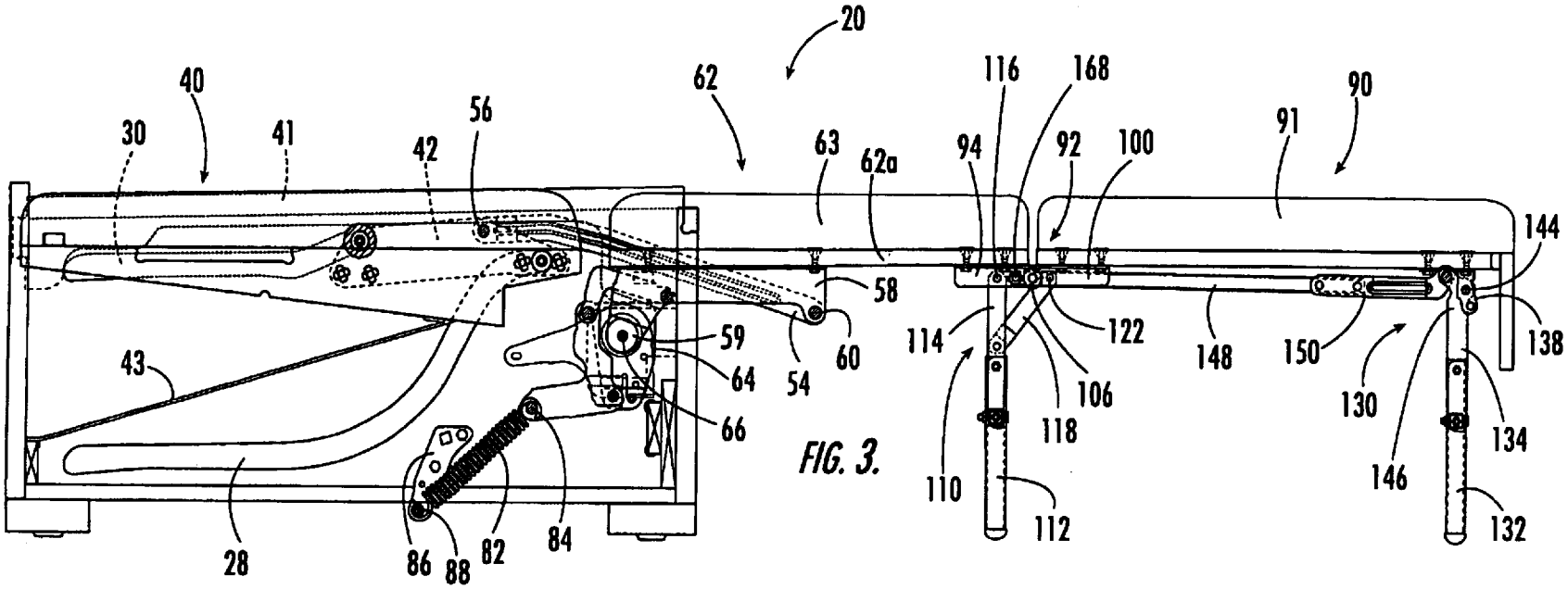
FIG. 3 is a cutaway side view of the sofa-bed of FIG. 1 in the unfolded position.

Referring now to FIGS. 1–3, a convertible sofa-bed, designated broadly at 20, is illustrated herein. The sofa-bed 20 includes a pair of generally upright rectangular arms 22, a backrest 40, a subseat 62, and a seat 90. Each of the backrest 40, subseat 62 and seat 90 includes a flat panel (designated at 40*a*, 62*a* and 90*a*, respectively) and an upholstered cushion (designated at 41, 63 and 91, respectively, and usually formed of a medium to high density foam) releasably (via a zipper or the like) or permanently fixed thereto (in many embodiments, a removable cushion (not shown) overlies the seat cushion 91 and is removed prior to the unfolding of the sofa-bed 20). These parts are interconnected with a pair of connecting links 54 and a hinge 92 such that they can be converted from the sofa configuration illustrated in FIG. 1 to the bed configuration illustrated in FIG. 3.

The sofa bed 20 is essentially a pair of mirror images about a vertical plane P (see FIGS. 6 and 7) that extends through the center of the backrest 40, the subseat 62, and the seat 90 equidistant between the arms 22. As such, except where indicated, only the structures on one side of the sofa-bed 20 is described herein in detail; those skilled in this art will understand that this description is equally applicable to the mirror image structures on the opposite side of the sofa-bed 20.

In addition, as used herein the terms "lateral", "outward" and derivatives thereof indicate the directions defined by a vector beginning at the aforementioned plane P and extending normal thereto. Conversely, the terms "inward", "inboard" and derivatives thereof indicate the direction opposite the "outward" direction. Together, the "inward" and "outward" directions comprise the "transverse" axis of the sofa-bed 20. The "rear" of the unfolded sofa-bed 20 is located at the end of the sofa-bed 20 nearest the backrest 40, and the "front" of the sofa-bed 20 is located at the end opposite the backrest 40. The "front" and "rear" directions comprise the "longitudinal" axis of the sofa-bed 20. The "head" of the unfolded sofa-bed 20 is the end formed by the backrest 40, and the "foot" of the unfolded sofa-bed 20 is the end formed by the seat 90.

In addition, some components of the sofa-bed 20 are illustrated herein as a series of pivotally interconnected links. Those skilled in this art will appreciate that the pivots between links can take a variety of configurations, such as pivot pins, rivets, bolt and nut combinations, and the like, any of which may be suitable for use with the present invention. Also, the shapes and configurations of the links themselves may vary as understood by those skilled in this art.

Returning to the drawings, and referring again to FIGS. 1–3, the arms 22 are interconnected with a transversely-extending rear rail 24 and a transversely-extending front rail 26. With these rails 24, 26, the arms 22 form a box-like frame 21 for the sofa 20. Each arm 22 includes a lower slot 28, which extends from a lower rear corner of the arm 22 and extends forwardly and upwardly in a smoothly curving manner to terminate in an upper forward portion of the arm 22. The lower slot 28 includes a generally horizontal segment 28*a*, an upwardly and forwardly extending segment 28*b*, and a short forwardly and slightly upwardly extending segment 28*c*. The segments 28*a*, 28*b*, 28*c* merge smoothly to form of the lower slot 28. Each arm 22 also includes an upper slot 30 that extends between the upper rear corner of the arm 22 forwardly to terminate at a generally central, upper location in the arm 22. The upper slot 30 comprises a horizontal segment 30*a* and a slightly upwardly sloping segment 30*b* that merges smoothly with the horizontal segment 30*a*. The lower and upper slots 28, 30 may be lined with protective components, such as plastic shields (not shown).

Referring again to FIGS. 1–3, the backrest 40 includes a backrest bracket 42 at each of its lateral edges. An upper post 44 extends laterally from each backrest bracket 42 and fits within the upper slot 30 of its respective arm 22. Similarly, a lower post 46 extends laterally from each backrest bracket 42 to fit within the slot 28 of its respective arm 22. The upper and lower posts 44, 46 are sized and configured to slide within and pivot relative to, respectively, the upper and lower slots 30, 28. An optional elastic strap 43 or other biasing member extends between the rear rail 24 and the lower portion of the backrest panel 40*a*.

In the interest of clarity, the interconnection of the backrest 40, subseat 62 and seat 90 will be described in the unfolded position shown in FIG. 3. As shown in FIG. 3, a subseat bracket 58 is mounted to the panel 62*a* of the subseat 62 opposite the cushion 63. The subseat bracket 58 is then pivotally mounted to the inboard surface of the arm 22 via a subseat mounting bracket 64 at a pivot 66 located on a downwardly-extending tab 59 on the subseat bracket 58. The subseat bracket 58 includes a stop pin 58*a* that extends inwardly therefrom. The subset mounting bracket 64 also has an inwardly extending tab 64*a*. The subseat 62 is directly connected to the backrest 40 with a generally straight connecting link 54. The connecting link 54 is pivotally connected with the backrest bracket 42 at a pivot 56 located between the upper and lower posts 44, 46 and at its opposite end to the subseat bracket 58 at a pivot 60 located at a front portion of the subseat bracket 58.

Figure 6:
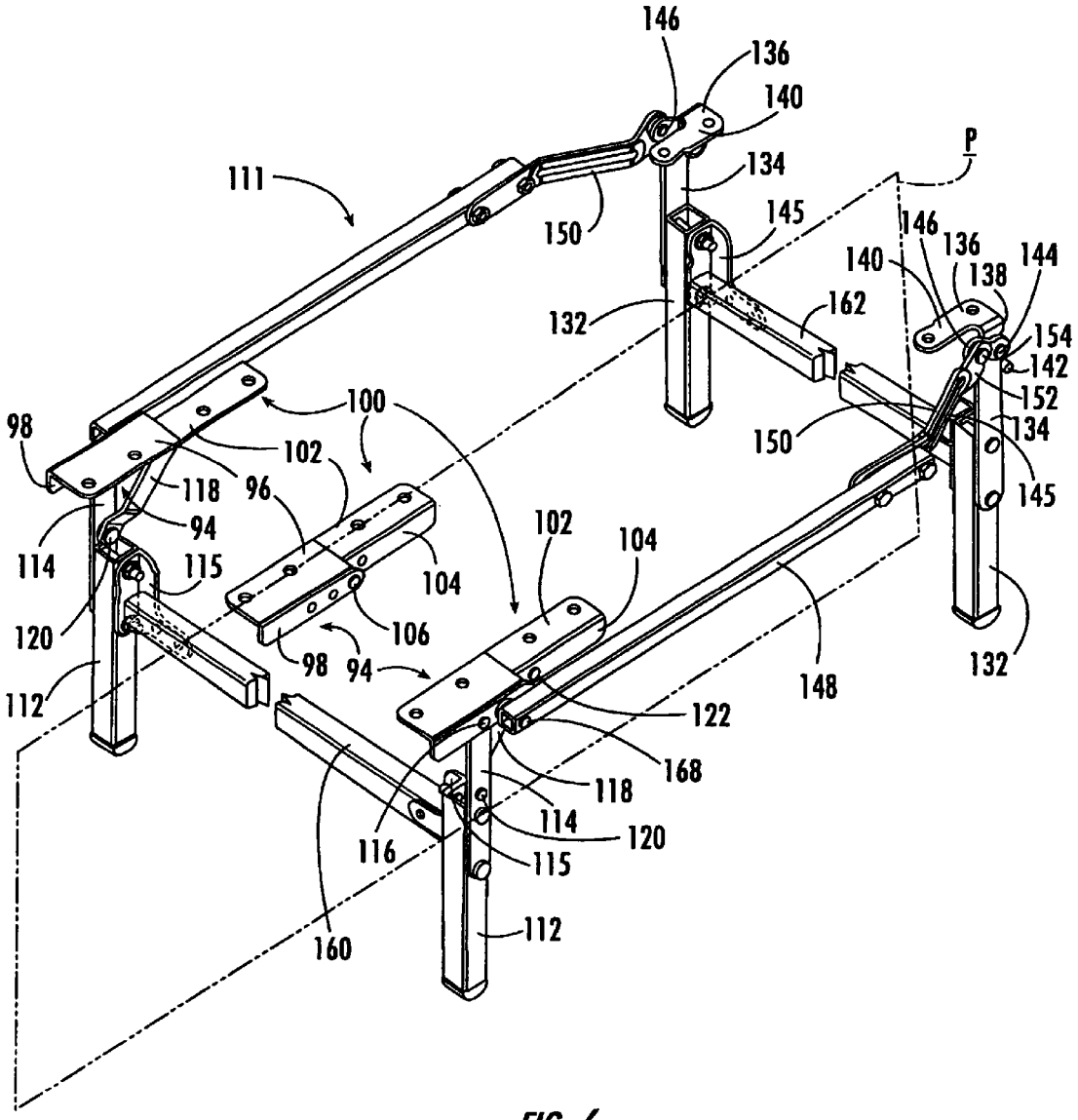
FIG. 6 is a cutaway perspective view of the center and end leg mechanisms of the sofa-bed of FIG. 1 in their unfolded positions.

Still referring to FIG. 3 and also referring to FIG. 6, the seat 90 is pivotally interconnected with the subseat 62 at a hinge 92. The hinge 92 includes three pairs of subseat plates 94 and seat plates 100 that are spaced transversely across the sofa-bed 20. Each subseat plate 94 includes a horizontal panel 96 and a vertical panel 98; similarly, the seat plates 100 include a horizontal panel 102, and a vertical panel 104. Each of the subseat plates 94 is pivotally interconnected with its respective seat plate 100 at a pivot 106 that is located in and attaches the vertical panels 98, 104.

To move the sofa bed 20 from the unfolded position of FIG. 3 to the folded position of FIG. 1, the operator lifts the foot end of the seat 90. This action causes the seat 90 to rise, which in turn causes the subseat 62 to rotate upwardly and rearwardly about the pivot 66 (counterclockwise from the vantage point of FIG. 3). This action also causes the seat 90 and subseat 62 to rotate relative to one another about the pivot 106. This action continues (see FIG. 2 for an intermediate position) until the subseat 62 is inverted and underlies the seat 90 in the manner shown in FIG. 1.

Moreover, as the subseat 62 rotates, its rotation drives the connecting link 54 rearwardly. This motion forces the backrest 40 rearwardly (in the unfolded position, both the upper and lower posts 44, 46 are completely forward in their respective slots 30, 28) and causes it to rotate (clockwise from the vantage point of FIG. 3), with its motion defined by the movement of the upper and lower posts 44, 46 within the upper and lower slots 30, 28. The elastic strap 43 remains in tension, with the result that the lower portion of the backrest 40 is biased toward the folded position (this biasing can help to provide smooth movement of the backrest 40 within the slots 28, 30). Movement of the sofa-bed 20 to the folded position ceases when the upper and lower posts 44, 46 reach the rearwardmost points of the upper and lower slots 30, 28. At this point, the subseat 62 is completely inverted and underlies the seat 90 with the cushion 63 facing downwardly. The seat 90 remains generally horizontal, with its cushion 91 facing upwardly.

To move the folded sofa-bed 20 back to the unfolded position of FIG. 3, the operator can lift on the front edge of the seat 90. Doing so causes the subseat 62 to rotate about the pivot 66 and to move forwardly. The movement of the subseat 62 draws the connecting link 54, and in turn the backrest 40, forwardly, with the backrest 40 also rotating as allowed by the upper and lower slots 30, 28.

Those skilled in this art will appreciate that, although the illustrated slots and posts are preferred for controlling the movement of the backrest 40, other mechanisms and structures for operatively connecting the backrest 40 and the frame 22, such as pivoting four-bar linkage mechanisms and the like, may also be employed with sofa-beds of the present invention. Also, the interconnection between the backrest 40, subseat 62 and seat 90 may take forms other than the direct interconnection provided by the connecting link 54.

Figure 7A:
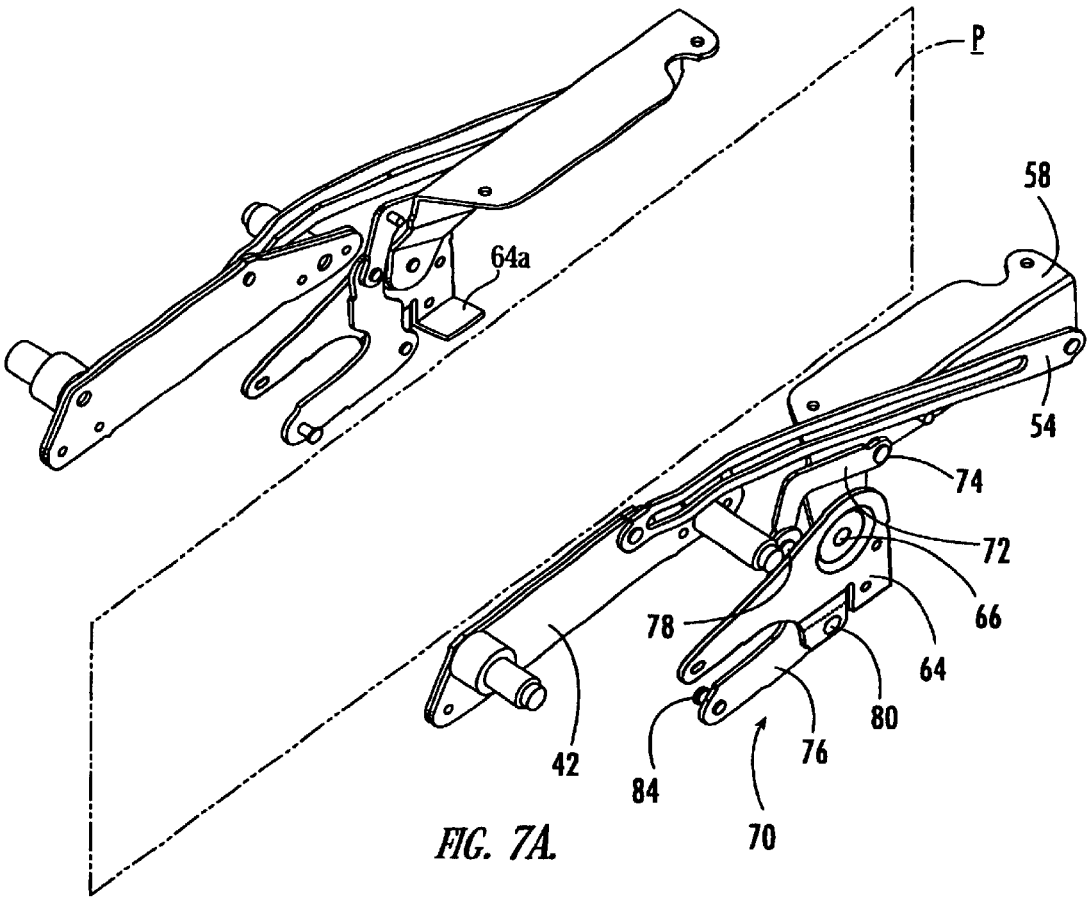
FIG. 7A is a cutaway perspective view of the balancing mechanism (without the spring) and the connecting link of the sofa-bed of FIG. 1 in their unfolded positions.
Figure 7B:
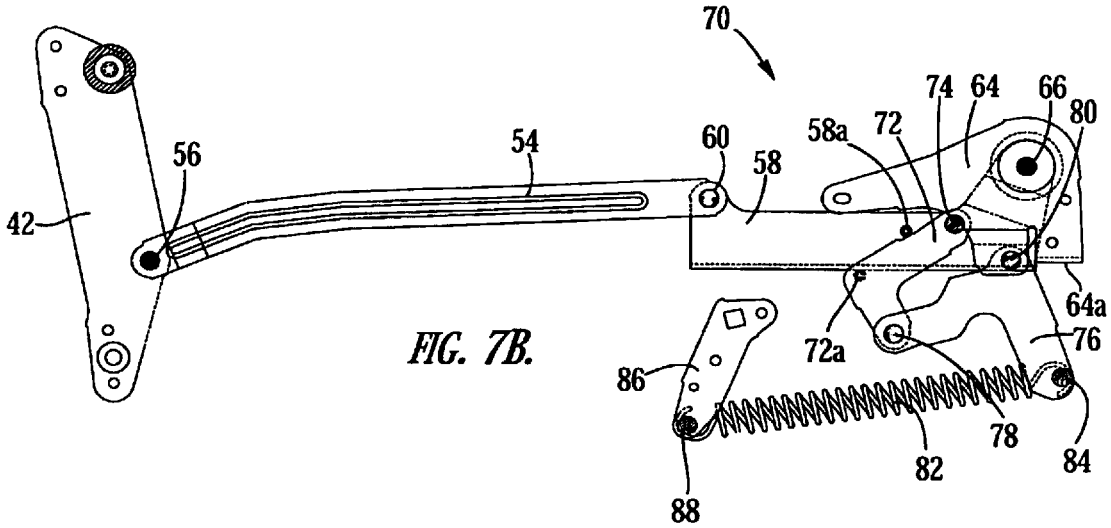
FIG. 7B is a side view of the balancing mechanism of FIG. 7A shown in its folded position.
Figure 7C:
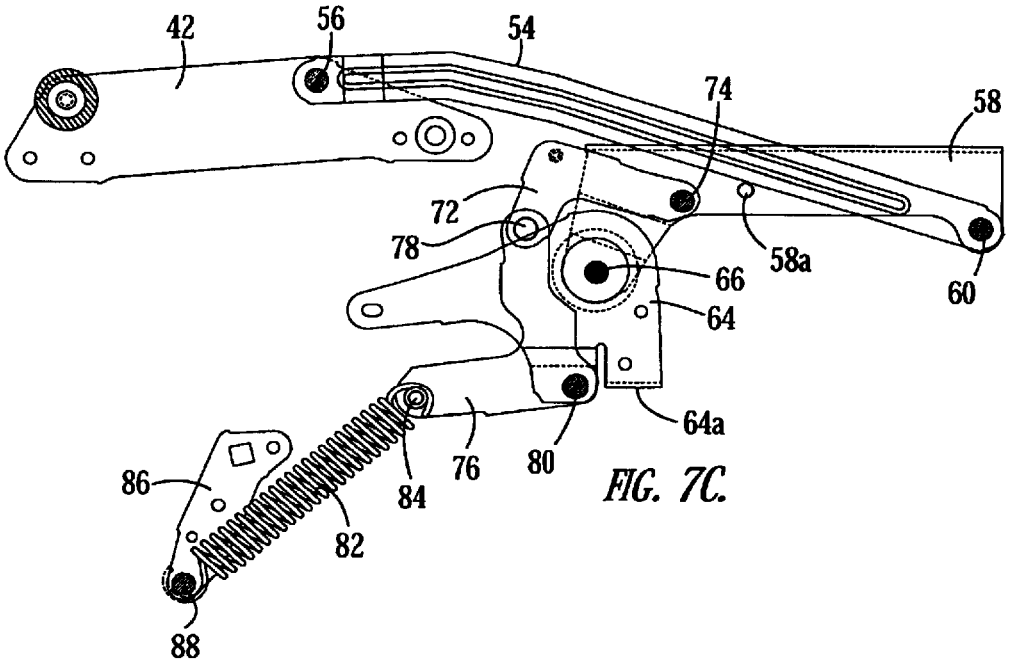
FIG. 7C is a side view of the balancing mechanism of FIG. 7A shown in its unfolded position.
Figure 8:
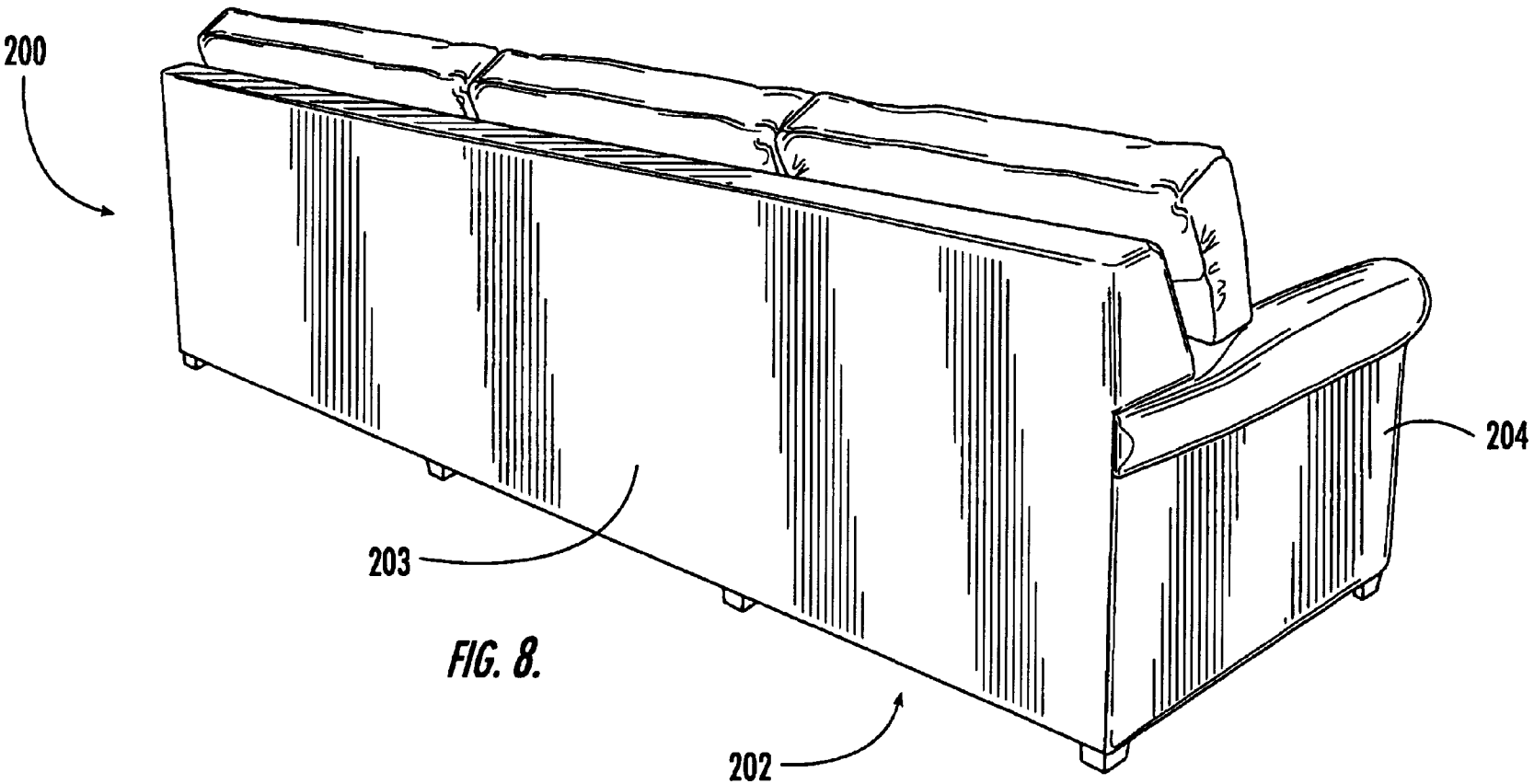
FIG. 8 is a rear perspective view of an alternative embodiment of a sofa-bed of the present invention.
Figure 9:
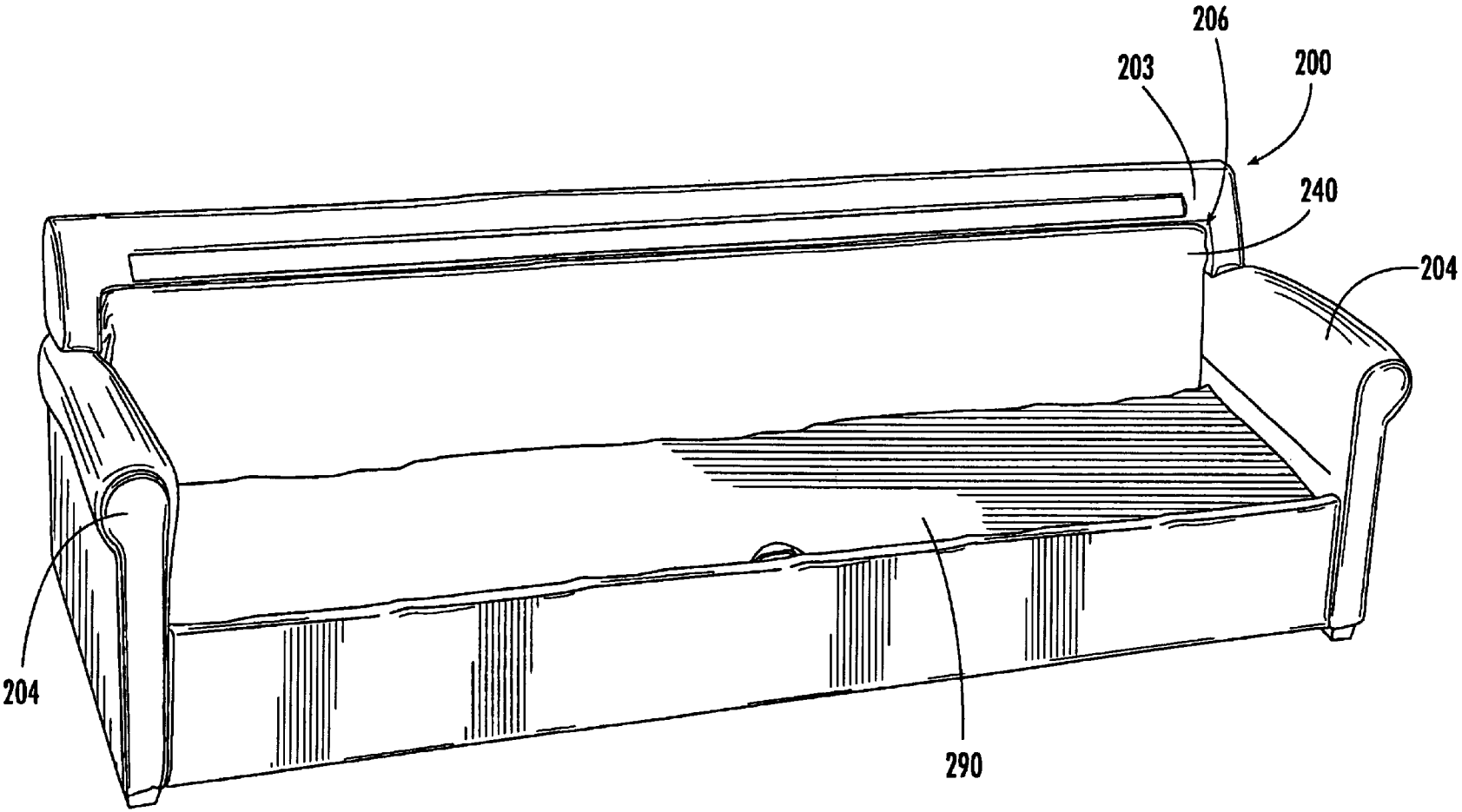
FIG. 9 is a front perspective view of the sofa-bed of FIG. 8 with the backrest cushion removed and the bed in the folded position.
Figure 10:
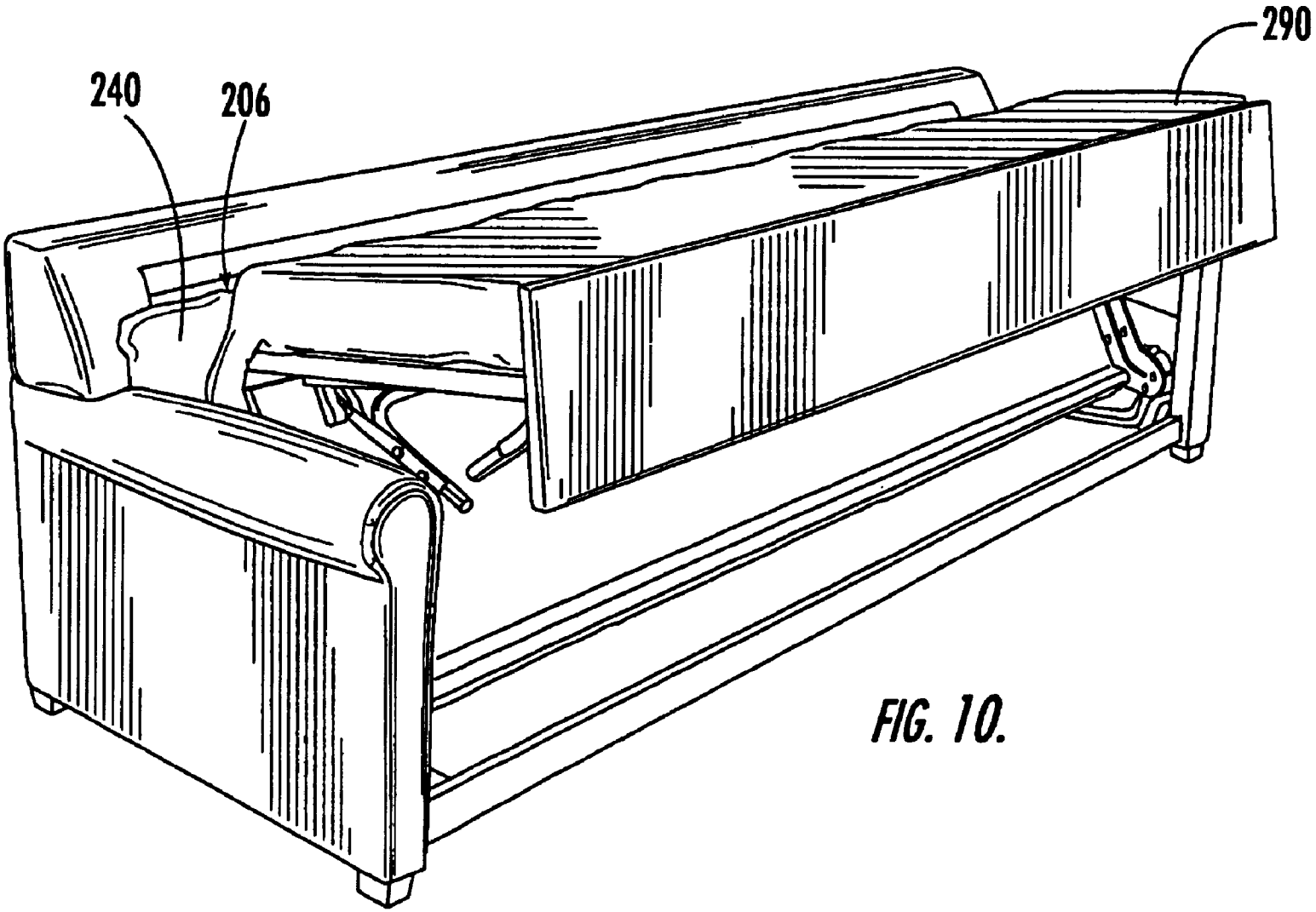
FIGS. 10–13 are front perspective views of the sofa-bed of FIG. 8 as it moves from the folded position to the unfolded position.
Figure 11:
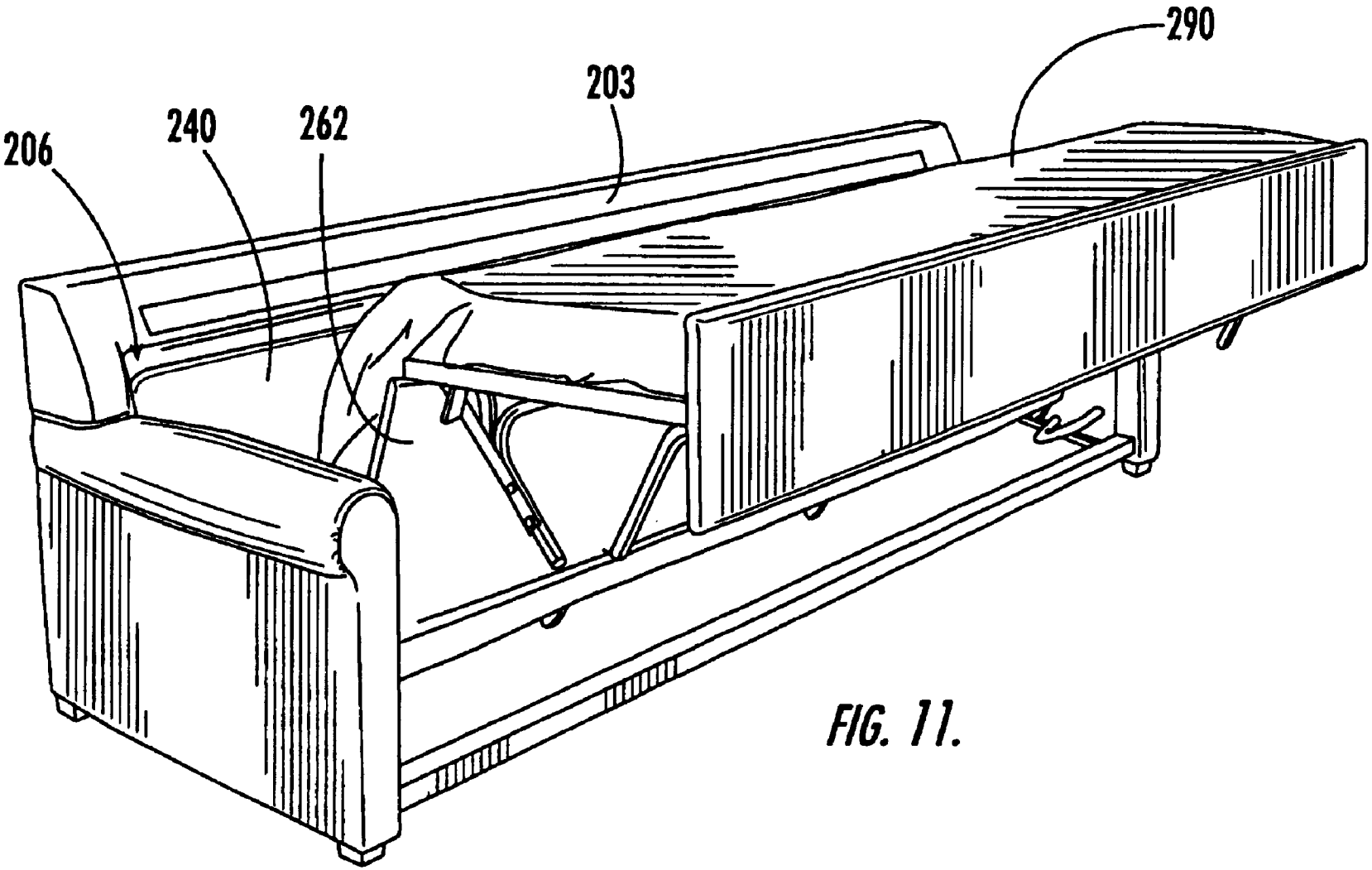
Figure 12:
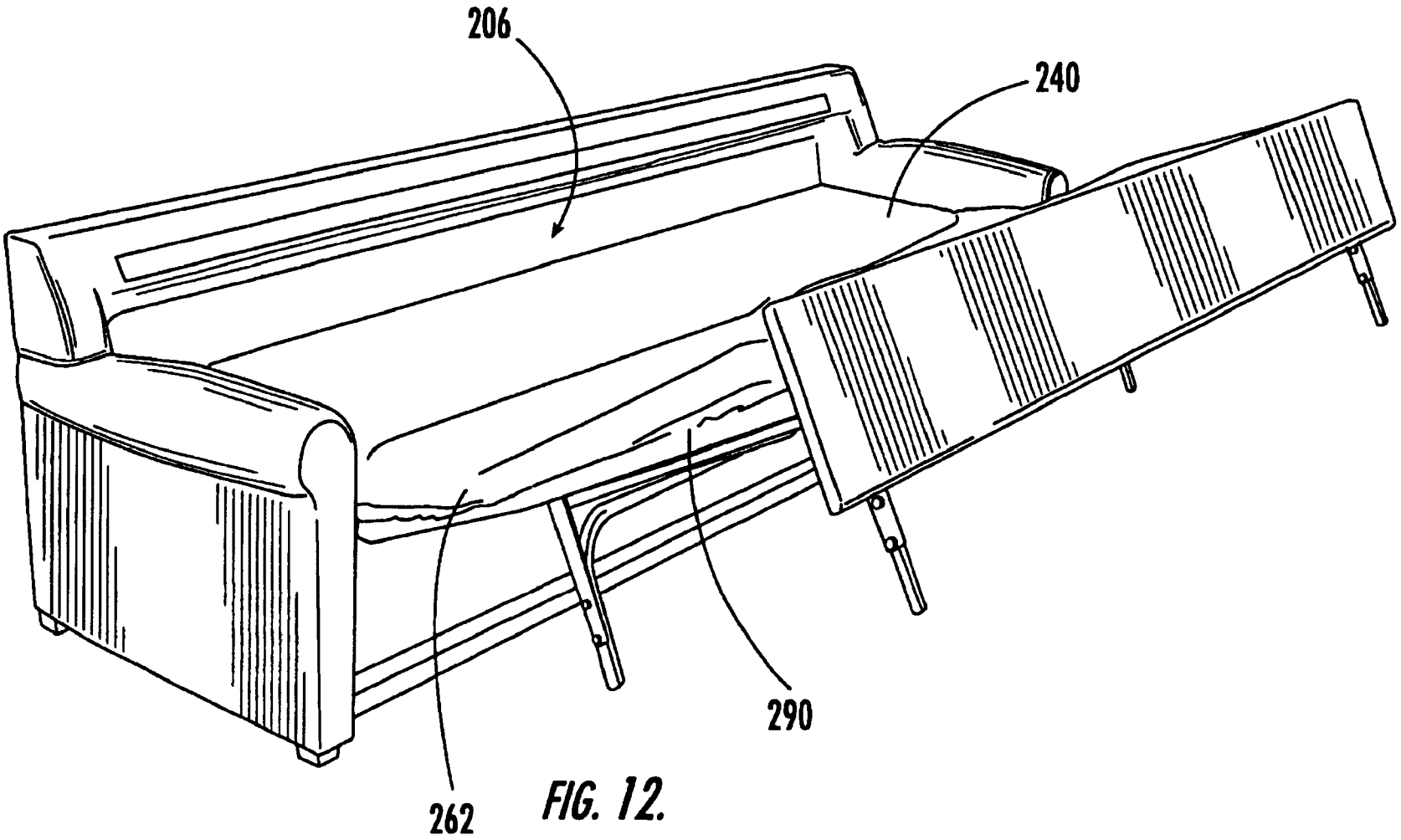
Figure 13:
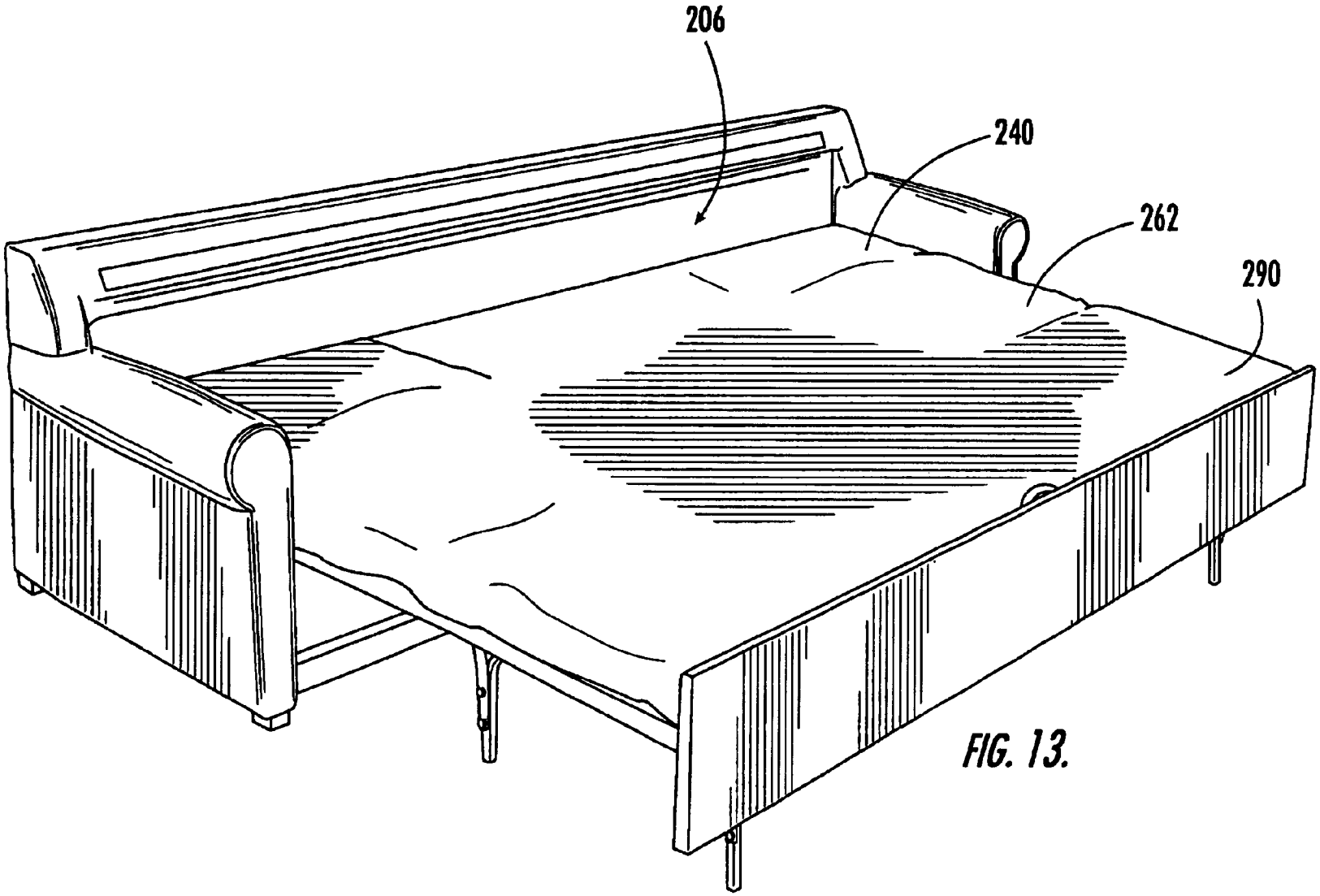
Figure 14A:
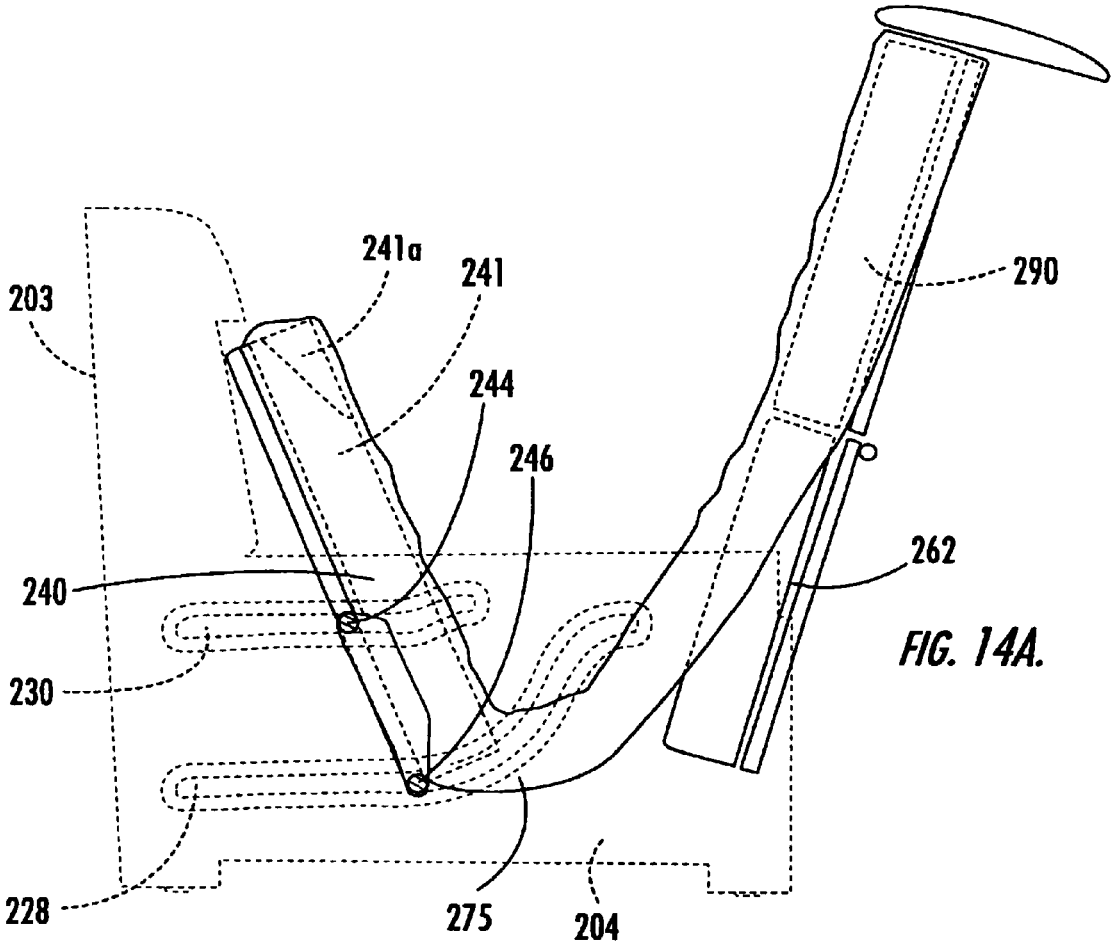
FIGS. 14A–14D are side views of the sofa-bed of FIG. 8 moving from a partially unfolded position to the folded position, wherein the draping of a sheet covering the mattress can be seen.
Figure 14B:
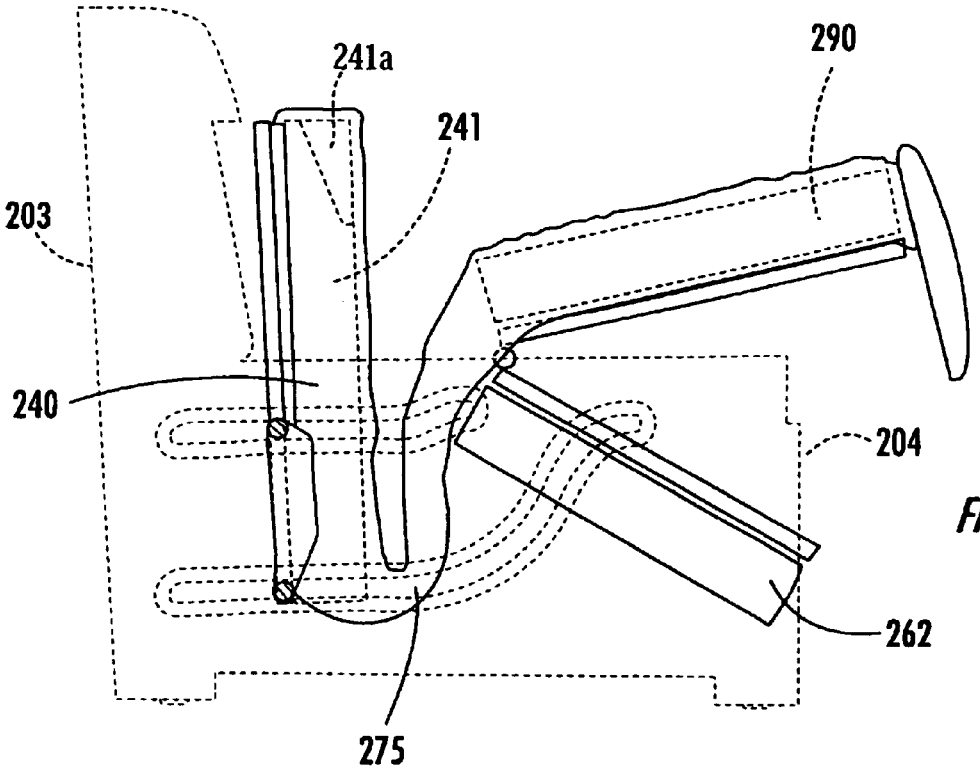
Figure 14C:
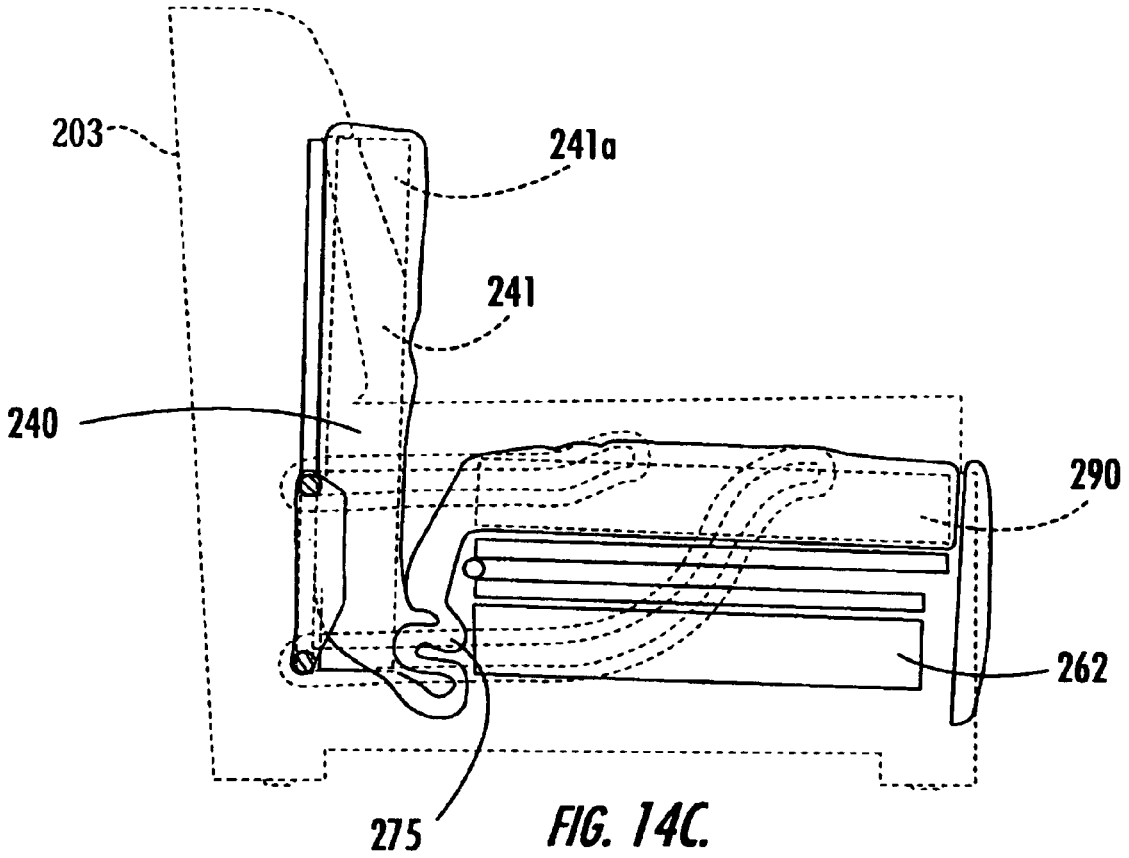
Figure 14D:
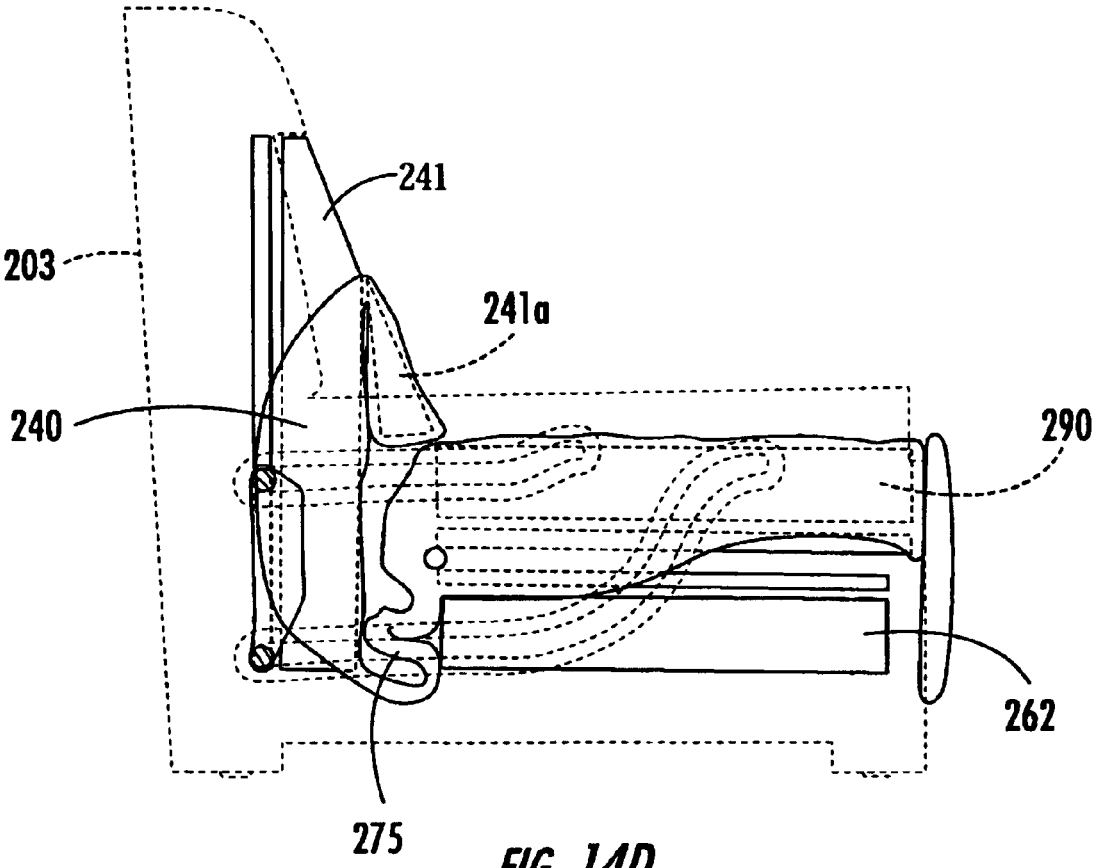

Referring again to FIG. 3 and also to FIGS. 7A–7C, a balance mechanism 70 is interconnected with the subseat 62 to provide assistance in the folding and unfolding of the sofa bed 20, as some of the components can be quite heavy. The balance mechanism 70 includes an L-shaped drawing link 72, which is pivotally interconnected at one end to the subseat bracket 58 at a pivot 74 near the subseat mounting bracket 64; at its opposite end, the drawing link 72 is pivotally interconnected to one end of a L-shaped crank 76 at a pivot 78. At its vertex, the drawing link 72 has an inwardly-extending stop pin 72*a*. The crank 76 is pivotally interconnected at its vertex to the subseat mounting bracket 64 at a pivot 80. The opposite end of the crank 76 includes a transversely-extending pin 84. A spring 82 is attached at one end to the pin 84 and is mounted to the arm 22 via a spring bracket 86 which includes a pin 88 that the spring 82 engages.

In the unfolded position illustrated in FIGS. 3, 7A and 7C, the drawing link 72 extends rearwardly and slightly upwardly from the pivot 74 to its vertex, then downwardly and slightly rearwardly to the pivot 78. The crank 76 extends downwardly from the pivot 78 to the pivot 80, then rearwardly to attach to the forward end of the spring 82. The spring 82 extends rearwardly and downwardly from the pin 84 to the pin 88 and is slightly in tension (preferably about 10 pounds of tension is provided by the combination of the springs 82 on each side of the sofa-bed 20). Notably, the pin 84, the pivot 66, and the pivot 74 form an "over-center" configuration, with the pivot 66 being positioned below a longitudinal axis defined by the spring 82, such that the tension in the spring 82 urges the sofa-bed 20 to remain in the unfolded position and "locks" it therein.

As the sofa-bed 20 moves to the folded position of FIGS. 1 and 7B, as described above, the subseat 62 is moving rearwardly and rotating to an inverted position. This movement of the subseat 62 drives the drawing link 72 rearwardly and causes the drawing link 72 to rotate counterclockwise. The movement and rotation of the drawing link 72 drives the crank 76 counterclockwise about the pivot 80. Once the crank 76 rotates sufficiently that the "over-center" alignment of the pin 84, the pivot 66, and the pivot 74 has been overcome, its rotation induces the spring 82 to continue to stretch, thereby providing increasing resistance to the rotation of the subseat 62 (i.e., the spring 82 biases the seat 90 and subseat 62 toward the unfolded position). This resistance can help to control the lowering of the seat 90 and subseat 62 into the frame of the sofa-bed 20, which may be desirable, as the seat 90 and subseat 62 can be quite heavy. In addition, the considerable tension in the spring 82 (preferably between about 120 and 160 pounds in the folded position, in which the spring 82 is stretched more than in the unfolded position) can also assist the operator in raising the seat 90 and subseat 62 from the frame to move the sofa-bed 20 into the unfolded position of FIG. 3. Thus, the configuration of the balance mechanism 70 can provide assistance to unfolding while enabling the seat 90 and subseat 62 to remain in the folded position when unfolding is not desired.

It can also be seen that in the folded position of FIG. 7B, the stop pin 72*a* contacts the underside of the subseat bracket 58, the stop pin 58*a* contacts the upper edge of the drawing link 72, and the tab 64*a* contacts the forward edge of the subseat bracket 58. These interactions help to support the seat 90 and subseat 62 in the folded position, which can enable the sofa-bed 20 to operate without one or more lower support rails included in prior sofa-beds of this type.

Those skilled in this art will appreciate that the balance mechanism 70 may take other configurations. For example, the shapes of the links comprising the balance mechanism 70 may be modified, as may the number of links or their interconnection relationship.

Figure 4:
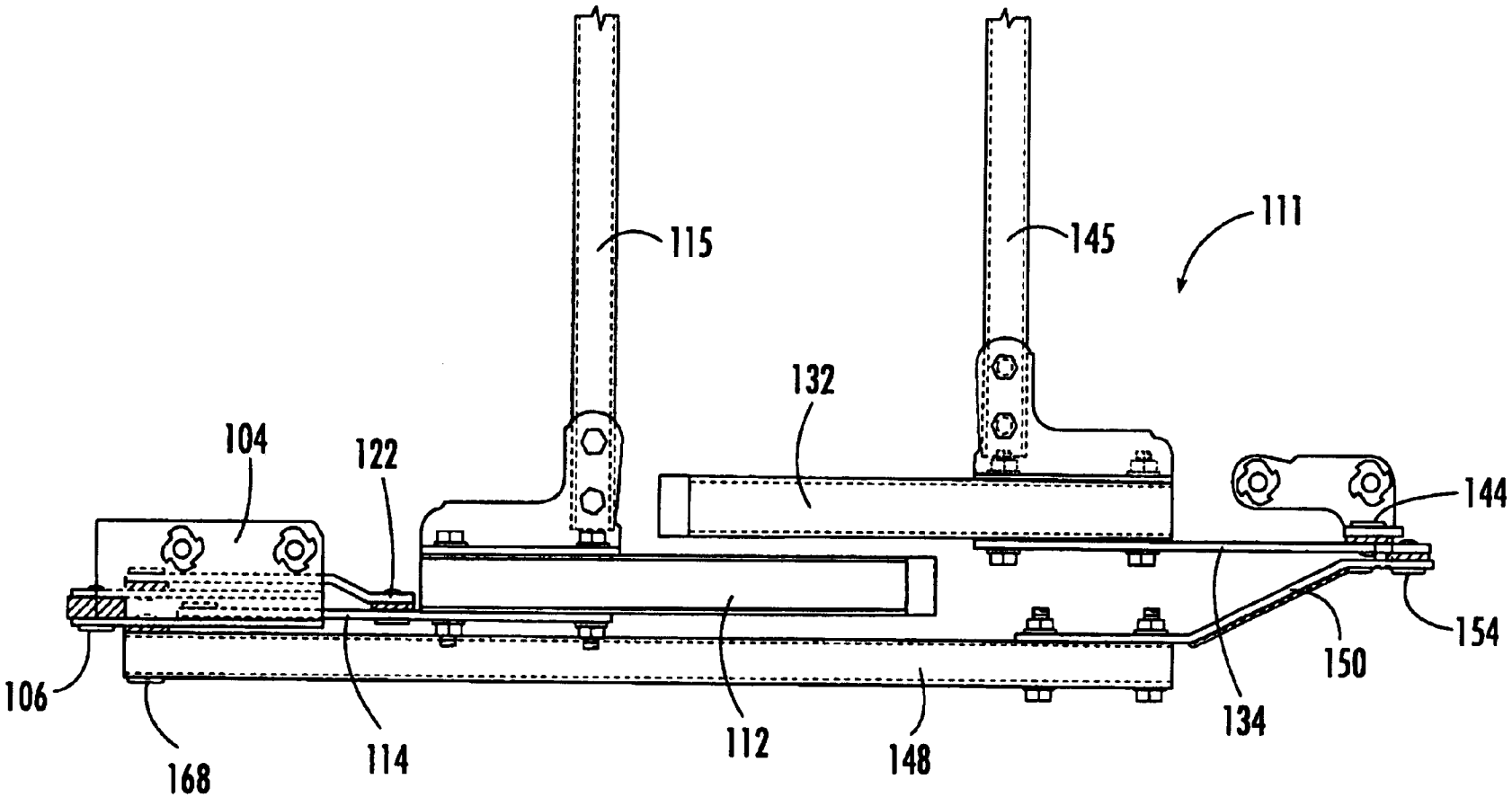
FIG. 4 is a partial top view of the center and end leg mechanisms of the sofa-bed of FIG. 1 in their folded positions.
Figure 5:
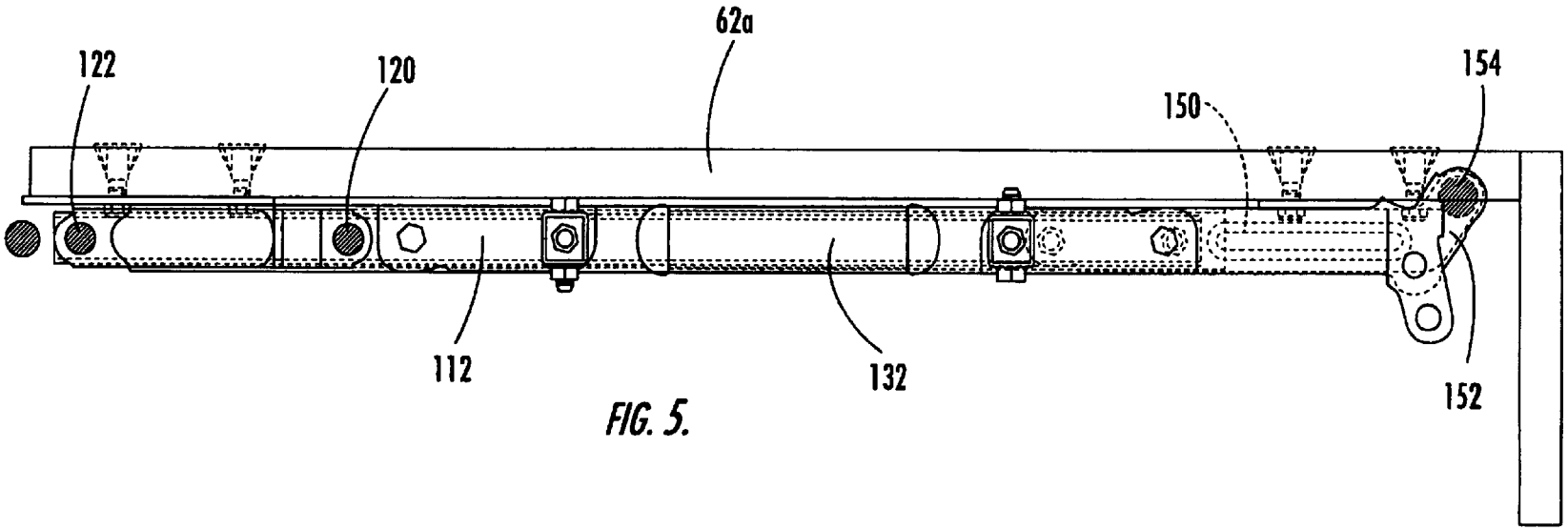
FIG. 5 is a partial side view of the center and end leg mechanisms of the sofa-bed of FIG. 1 in their folded positions.

It can also be seen that, in the unfolded position of FIG. 3, the subseat 62 and seat 90 are supported from below by legs 112, 132. As can be seen in the folded position of FIG. 1 and in FIGS. 4–6, the legs 112, 132 fold into positions between the seat 90 and the subseat 62. The movement of the legs 112, 132 is controlled by a center leg mechanism 110 and an end leg mechanism 130, which together comprise a leg-folding mechanism 111. These are described in detail below.

Referring to FIGS. 3 and 6, the center leg mechanism 110 includes a brace 118, which is pivotally interconnected at one end to the vertical panel 104 of the seat plate 100 at a pivot 122 that is located forwardly of the pivot 106, and at the other end at a pivot 120 to a flange 114 which extends upwardly from the leg 112. The flange 114 terminates at a pivot 116 with the vertical panel 98 of the subseat plate 94. Thus, a four-bar linkage is defined between the brace 118, the flange 114, the subseat plate 94, and the seat plate 100. The pivots 116, 106 and 122 are generally horizontally aligned when the sofa-bed 20 is in the unfolded position.

Still referring to FIGS. 3 and 6, the end leg mechanism 130 includes a flange 134 that extends upwardly from the leg 132, a seat bracket 136 having a vertical panel 138 and a horizontal panel 140, and a crank 150. The horizontal panel 140 of the seat bracket supports the panel 90*a* of the seat 90 from underneath. The flange 134 is connected to the vertical panel 138 of the seat bracket 136 at a pivot 144. The flange 134 includes an upwardly and rearwardly extending tab 146, at which point it is interconnected with an upwardly and forwardly extending tab 152 of the crank 150 at a pivot 154 that is located just upwardly and rearwardly of the pivot 144. The vertical panel 138 of the seat bracket 136 also includes a transversely-extending pin 142 that is positioned just forwardly of the front end of the flange 134. A connecting tube 148 is fixed to the rearward end of the crank 150 and also is pivotally connected to the vertical panel 98 of the subseat plate 94 between the pivots 116, 106 at a pivot 168.

Referring still to FIGS. 3 and 6, the legs 112 on either side of the sofa bed 20 are interconnected via a cross tube 160 (which extends between brackets 115 mounted to and extending transversely from an upper portion of each leg 112) and the legs 132 on either side of the bed are connected via a cross tube 162 (which extends between brackets 145 mounted to and extending transversely from an upper portion of each leg 132). The cross tubes 160, 162 assist in synchronizing the motion of the legs and in providing stability to the sofa-bed 20 when it is in the unfolded position. Also, the cross tube 160 and legs 112 may be formed as a unitary member from a single length of tubing; similarly, the cross tube 162 and legs 132 can be formed as a unitary member.

As noted above, to move the sofa bed 20 from the unfolded position of FIG. 3 to the folded position of FIG. 1, the operator lifts on the foot end of the seat 90. This action causes the seat 90 to rise, which in turn causes the subseat 62 to rotate upwardly and rearwardly about the pivot 66 and causes the seat 90 and subseat 62 to rotate relative to one another about the pivot 106. As the relative rotation of the seat 90 and subseat 62 continues, the subseat plate 94 rotates with the subseat 62. The action of the subseat plate 94 drives the lower end of the flange 114 forwardly and upwardly; also, the lower end of the brace 118 is driven upwardly and forwardly. The movement of the flange 114 draws the leg 112 from its generally upright orientation toward the underside of the seat 90. This action is completed when the leg 112 folds completely under the seat 90 and is generally horizontally disposed and sandwiched between the seat 90 and subseat 62 (see FIGS. 4 and 5).

In addition, the pivoting of the subseat 62 relative to the seat 90 drives the connecting tube 148 and crank 150 forwardly toward the foot end of the seat 90. This action causes the flange 134 to rotate about the pivot 144 such that the leg 132 moves from its generally upright orientation to collapse below the seat 90 in a generally horizontal disposition. This action continues until the subseat 62 is inverted and positioned below the seat 90 (see FIGS. 1, 4 and 5). The center legs 112 and the end legs 132 define a substantially horizontal plane, with the end legs 132 being positioned inboard of the center legs 112.

When the sofa-bed 20 is returned to the unfolded position, the movements described herein for the center leg mechanism 110 and the end leg mechanism 130 are reversed. Movement of the legs 112, 132 ceases when the forward edge of the flange 134 strikes the pin 142 (which should coincide with the upper and lower posts 44, 46 of the backrest 40 reaching the forward ends of the upper and lower slots 30, 28.

Those skilled in this art will recognize that other leg mechanisms may also be suitable for use with sofa-beds of the present invention. For example, the shapes and pivot points of members thereof may be modified, or links may be added or omitted as desired.

Another embodiment of a sofa-bed of the present invention, designated broadly at 200, is illustrated in FIGS. 8–14D. The sofa-bed 200 includes a seat 290 and a subseat 262 that are substantially identical to the seat 90 and subseat 62 of the embodiment illustrated in FIGS. 1–7; however, the sofa-bed 200 has a frame 202 that includes a back panel 203 that is fixed to the arms 204 and extends upwardly above the height of the arms 204 (typically at least 1 to 15 inches from the underlying surface). The back panel 203, which typically has an upper edge that is higher than the arms 204, includes a recess 206 in which the backrest 240 resides when the sofa-bed 200 is in the folded position (see FIG. 9). The sofa-bed 200 moves between the folded and unfolded positions in much the same manner as the sofa-bed 20 of FIGS. 1–7 (see FIGS. 9–13).

Referring now to FIGS. 14A–14D, the movement of the backrest 240 between the folded and unfolded positions is controlled by the movement of upper and lower posts 244, 246 within, respectively, upper and lower slots 230, 228 in the arms 204. It should also be noted that, in the folded position (see FIG. 14D), the backrest 240 is substantially vertical. Notably, the backrest cushion 241 includes a wedge-shaped section 241 a that is hinged (preferably with a cloth hinge) at its lower end to the remainder of the backrest cushion 241. The wedge-shaped section 241*a* can pivot about its hinge from the position shown in FIGS. 14A–C, in which it overlies the end of the backrest cushion 41 and forms a flat surface with the remainder of the backrest cushion 241, to the position shown in FIG. 14D, in which it has rotated approximately 180 degrees and forms a supporting lumbar structure just above and rearwardly of the seat 290.

The inclusion of the back panel 203 can provide a more pleasing appearance from the rear of the sofa-bed 200 because no gaps exist between the back panel 203 and the arms 204. While not only providing an improved appearance, the inclusion of the back panel 203 can also allow a sheet 275 to be left in place as the sofa-bed 200 is in the folded position (see FIGS. 8 and 14A–14D) without detracting from the appearance of the sofa-bed 200, as the sheet 275 would not be visible.

Figure 15A:
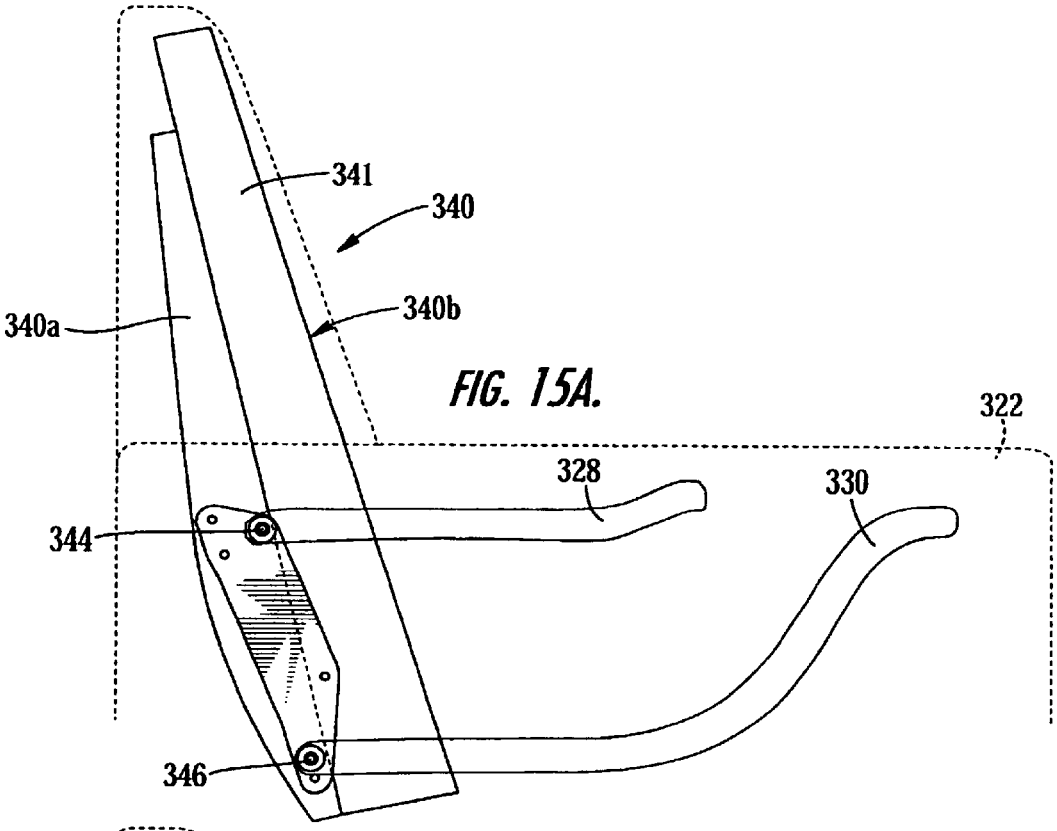
FIG. 15A is a side view of another embodiment of a sofa-bed of the present invention, with the sofa-bed shown in the unfolded position.
Figure 15B:
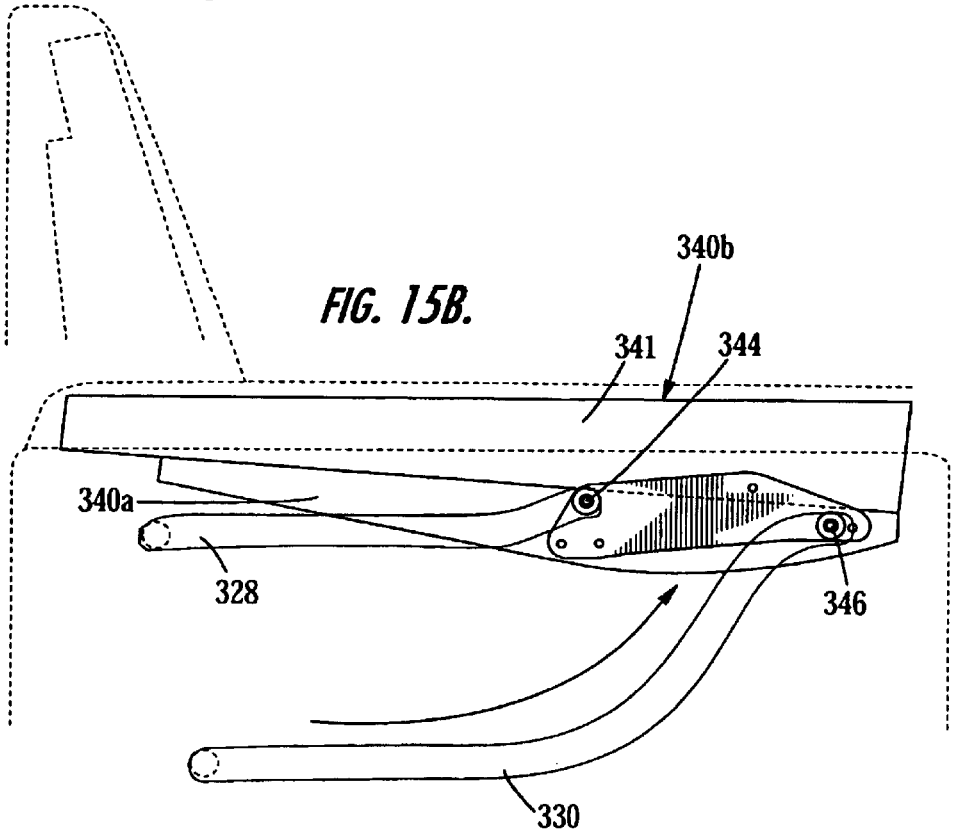
FIG. 15B is a partial side view of the sofa-bed of FIG. 15A showing the backrest in the folded position.

Referring now to FIGS. 15A and 15B, another embodiment of a sofa-bed of the present invention is illustrated. The sofa-bed, designated broadly at 300, includes a similar frame, subseat, and seat as the sofa-bed 200. However, the arms 322 of the sofa-bed 300 include upper and lower slots 328, 330 that differ in configuration from the slots 28, 30 and 228, 230 of the embodiments of FIGS. 1–14D. The upper slot 328 extends rearwardly relative to the lower slot 330 (the upper and lower slots 228, 230 extend rearwardly to approximately the same point); the rearwardmost end of the upper slot 328 is between about 1 and 3 inches rearward of the rearwardmost end of the lower slot 330. Also, the backrest 340 includes a cushion 341 that is tapered as it extends away from the front of the arm 322.

In the folded position (FIG. 15A), the upper and lower posts 344, 346 attached to the backrest 340 are positioned in their rearwardmost positions in the upper and lower slots 328, 330. As a result, the panel 340*a* of the backrest 340 is generally upright, with a slight rearward tilt relative to vertical. Due to the taper in the backrest cushion 341, the front surface 340*b* of the backrest cushion 341 has a greater rearward tilt than the panel 340*a*. Consequently, the backrest cushion 341 need not have a wedge-shaped section (like that of the sofa-bed 200) to provide a comfortable inclined backrest surface.

Both of the sofa-bed embodiments 200, 300 can be positioned with their respective back panels immediately adjacent a wall and moved between the folded and unfolded positions without striking the wall. As such, these embodiments do not require some space (usually 3 inches or so) between the backrest and the wall to allow the bed to move between positions.

Still another embodiment of the present invention is illustrated in FIGS. 16–19. A sofa-bed, designated broadly at 400, includes a backrest 440 of similar configuration to those illustrated in the embodiments described above. The subseat 462, however, lacks an attached cushion of the type shown in the embodiments of FIGS. 1–15B. The seat 490 includes a seat cushion 491 of the type shown in the previous embodiments. A subseat cushion 492 is attached via a cloth hinge 493 to the rear edge of the seat cushion 491. In the folded position, the subseat cushion 492 is in stacked relationship overlying the seat cushion 491. As such, the subseat cushion 492 can serve as the cushion upon which an occupant sits when the sofa-bed 400 is in the folded position; there is no need to include an additional separate cushion that is removed prior to the unfolding of the sofa-bed 400.

Figure 16:
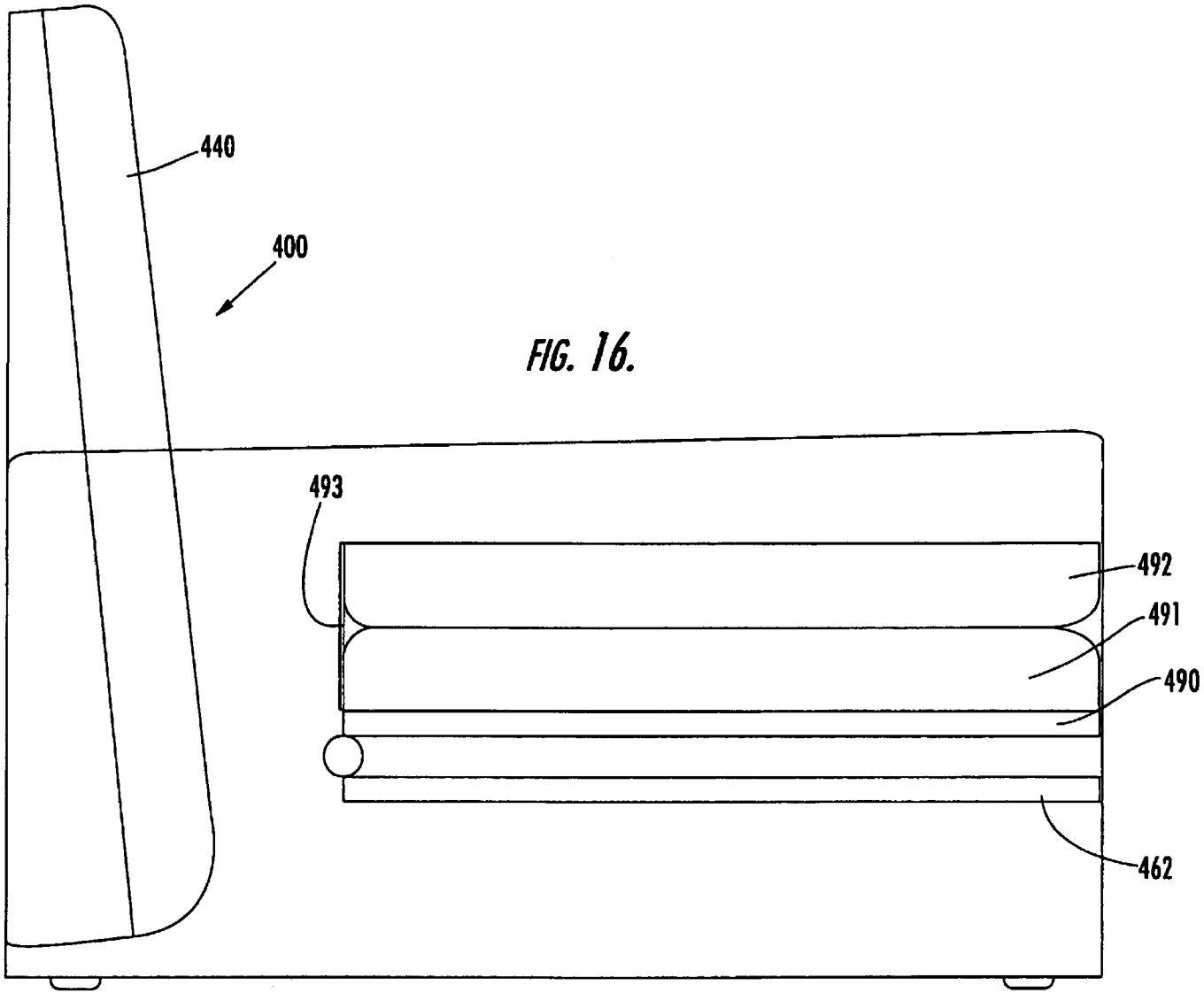
FIG. 16 is a schematic side view of another embodiment of a sofa-bed of the present invention shown in the folded position.
Figure 17:
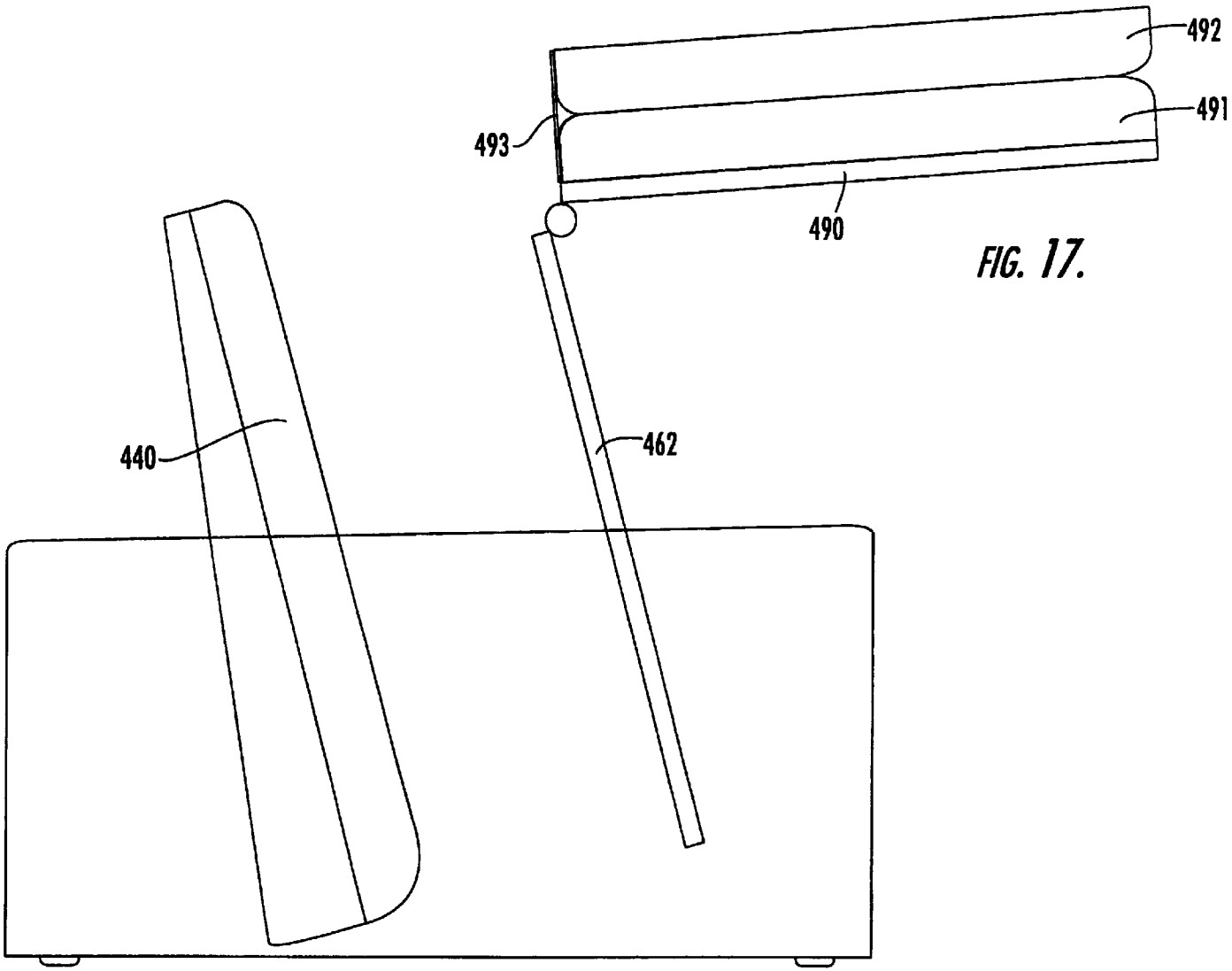
FIG. 17 is a schematic side view of the sofa-bed of FIG. 16 in an intermediate position between the folded and unfolded positions.
Figure 18:
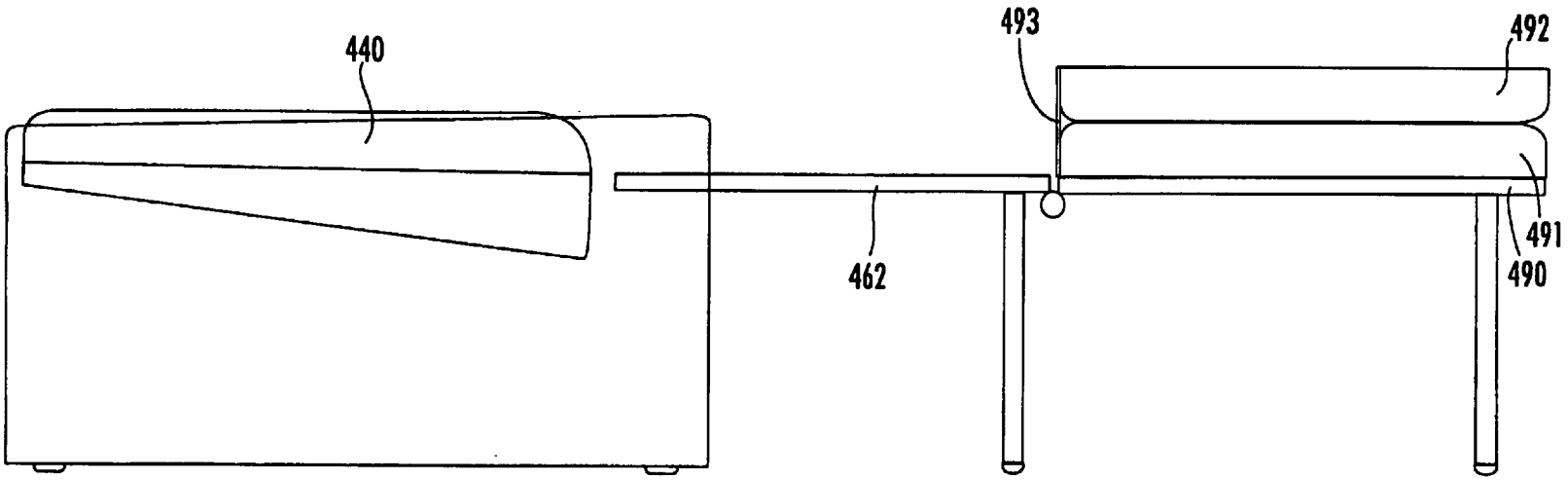
FIG. 18 is a schematic side view of the sofa-bed of FIG. 16 in the unfolded position, with the subseat and seat cushions in a stacked relationship.
Figure 19:
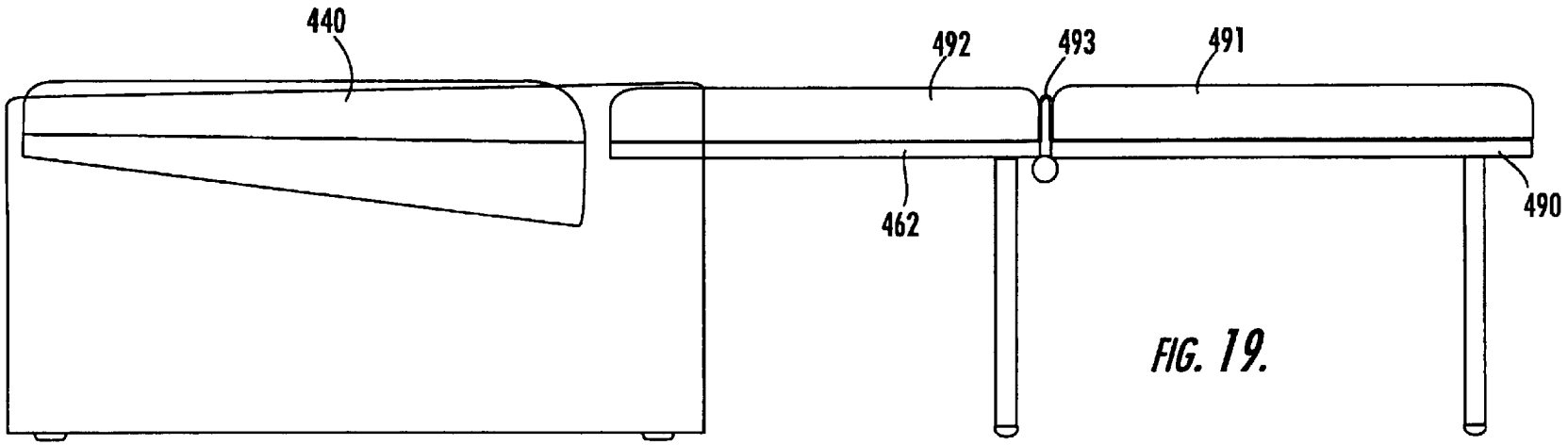
FIG. 19 is a schematic side view of the sofa-bed of FIG. 16 in the unfolded position with the subseat and seat cushions in an outspread relationship.

Folding and unfolding of the sofa-bed 400 is carried out in much the same manner as for the embodiments of FIGS. 1–15B: the backrest 440 follows a similar path, typically controlled by posts moving within slots in the arms of the sofa-bed 400, the seat 490 moves from a horizontal position within the frame to a horizontal position forward of the frame, and the subseat 462 moves from an inverted position to a non-inverted position between the seat 490 and the backrest 440 (see FIGS. 16–18). Once the sofa-bed 400 is in the unfolded position, the subseat cushion 492 can be inverted by pivoting it about the cloth hinge 493 to an inverted position overlying the subseat 462 (FIG. 19).

The configuration of the sofa-bed 400 is particularly desirable in environments in which it may be unappealing to have a removable seat cushion. Exemplary environments include hospital rooms or other health care facilities, where it may be desirable to have furniture that converts between a seating unit and a bed (for example, for an individual who chooses to stay with a patient in a hospital room) but may be undesirable to have loose cushions in the room for space or sanitary reasons.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A sofa-bed, comprising:

a frame with opposing arms;

a backrest operatively connected with the frame such that the backrest can pivot and slide relative to the frame;

a seat;

a subseat hinged to the seat and pivotable relative thereto at a first pivot;

a connecting member that pivotally interconnects the subseat and the backrest;

pairs of center legs and end legs pivotally interconnected with, respectively, the subseat and seat; and a leg-folding mechanism pivotally interconnected with the center and end legs, wherein the frame, backrest, seat and subseat are configured such that the backrest, seat and subseat move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation;

wherein the leg-folding mechanism is configured to move the center and end legs from a generally horizontal folded position between the seat and subseat when the sofa-bed is in the folded position to a generally upright position beneath, respectively, the subseat and seat when the bed is in the unfolded position;

wherein the leg-folding mechanism includes a center leg mechanism and an end leg mechanism;

wherein the center leg is pivotally interconnected with the subseat at a second pivot, the second pivot being rearward of the first pivot when the sofa-bed is in the unfolded position;

wherein the center leg mechanism includes a brace that is pivotally interconnected with the center leg and with the seat; and wherein the subseat and seat are interconnected via a hinge, and wherein the hinge includes a subseat plate fixed to the subseat, and wherein the center leg is pivotally interconnected to the subseat plate at the second pivot.

2. The sofa-bed defined in claim 1, wherein the hinge further includes a seat plate fixed to the seat, and wherein the brace is pivotally interconnected with the seat plate at a third pivot.

3. The sofa-bed defined in claim 2, wherein the first, second and third pivots are substantially horizontally aligned when the sofa-bed is in the unfolded position.

4. The sofa-bed defined in claim 2, wherein the end leg mechanism includes a connecting member that is pivotally interconnected with the subseat at a fourth pivot and with the end leg at a fifth pivot, the end leg being pivotally interconnected with the seat at a sixth pivot, the fifth pivot being positioned upwardly and rearwardly of the sixth pivot when the bed is in the unfolded position, and wherein the connecting member is connected to the subseat plate at the fourth pivot, and wherein the first, second, third and fourth pivots are substantially horizontally aligned when the sofa-bed is in the unfolded position.

5. A sofa-bed, comprising:

a frame with opposing arms;

a backrest operatively connected with the frame such that the backrest can pivot and slide relative to the frame;

a seat;

a subseat hinged to the seat and pivotable relative thereto at a first pivot;

a connecting member that pivotally interconnects the subseat and the backrest;

pairs of center legs and end legs pivotally interconnected with, respectively, the subseat and seat; and a leg-folding mechanism pivotally interconnected with the center and end legs, wherein the frame, backrest, seat and subseat are configured such that the backrest, seat and subseat move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation; and wherein the leg-folding mechanism is configured to move the center and end legs from a generally horizontal folded position between the seat and subseat when the sofa-bed is in the folded position to a generally upright position beneath, respectively, the subseat and seat when the bed is in the unfolded position.

6. The sofa-bed defined in claim 5, wherein the connecting member directly interconnects the subseat and the backrest.

7. The sofa-bed defined in claim 5, wherein the backrest includes an upper post that is slidable and pivotable within an upper slot in the frame arm and a lower post that is slidable and pivotable within a lower slot in the frame arm.

8. The sofa-bed defined in claim 5, wherein the leg-folding mechanism includes a center leg mechanism and an end leg mechanism.

9. The sofa-bed defined in claim 8, wherein the center leg is pivotally interconnected with the subseat at a second pivot, the second pivot being rearward of the first pivot when the sofa-bed is in the unfolded position.

10. The sofa-bed defined in claim 9, wherein the center leg mechanism includes a brace that is pivotally interconnected with the center leg and with the seat.

11. The sofa-bed defined in claim 8, wherein the end leg mechanism includes a connecting member that is pivotally interconnected with the subseat at a fourth pivot and with the end leg at a fifth pivot, the end leg being pivotally interconnected with the seat at a sixth pivot, the fifth pivot being positioned upwardly and rearwardly of the sixth pivot when the bed is in the unfolded position.

12. The sofa-bed defined in claim 8, wherein the center leg mechanism and the end leg mechanism are configured such that, when the sofa-bed is in the folded position, the center legs extend forwardly, and the end legs extend rearwardly.

13. The sofa-bed defined in claim 12, wherein, when the sofa-bed is in the folded position, the center legs and end legs define a substantially horizontal plane.

14. The sofa-bed defined in claim 13, wherein, when the sofa-bed is in the folded position, the end legs are positioned inboard of the center legs.

15. The sofa-bed defined in claim 5, further comprising a biasing member attached to the frame and the backrest to bias the backrest toward the folded position.

16. A sofa-bed, comprising:

a frame with opposing arms;

a backrest operatively connected with the frame such that the backrest can pivot and slide relative to the frame;

a seat;

a subseat hinged to the seat and pivotable relative thereto at a first pivot;

a connecting member that pivotally interconnects the subseat and the backrest; and a balance mechanism attached to at least one of the frame, backrest subseat and seat;

wherein the frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation; and wherein the balance mechanism is configured such that the subseat and seat are biased toward the unfolded position as the sofa-bed approaches the folded position.

17. The sofa-bed defined in claim 16, wherein the balance mechanism is configured so that the sofa-bed is locked in the unfolded position.

18. The sofa-bed defined in claim 17, wherein the balance mechanism is attached to the arms and to the subseat.

19. The sofa-bed defined in claim 16, wherein the connecting member directly interconnects the subseat and the backrest.

20. The sofa-bed defined in claim 16, wherein the backrest includes an upper post that is slidable and pivotable within an upper slot in the frame arm and a lower post that is slidable and pivotable within a lower slot in the frame arm.

21. The sofa-bed defined in claim 16, further comprising a biasing member attached to the frame and to the backrest that biases the backrest toward the folded position.

22. A sofa-bed, comprising:

a frame with opposing arms;

a backrest operatively connected with the frame such that the backrest can pivot and slide relative to the frame;

a seat;

a subseat hinged to the seat and pivotable relative thereto at a first pivot;

a connecting member that pivotally interconnects the subseat and the backrest; and a balance mechanism attached to at least one of the frame, backrest subseat and seat;

wherein the frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation;

wherein the balance mechanism is configured such that the subseat and seat are biased toward the unfolded position as the sofa-bed approaches the folded position;

wherein the balance mechanism is configured so that the sofa-bed is locked in the unfolded position;

wherein the balance mechanism is attached to the arms and to the subseat; and; wherein the balance mechanism includes:

a subseat bracket fixed to the subseat;

a subseat mounting bracket fixed to the arm, the subseat bracket being pivotally interconnected to the subseat mounting bracket at a first pivot;

a drawing link pivotally attached to the subseat bracket at a second pivot;

a crank pivotally attached to the drawing link and to the subseat mounting bracket;

a spring pivotally attached to the crank at a third pivot; and a spring mounting bracket fixed to the arm.

23. The sofa-bed defined in claim 22, wherein, when the sofa-bed is in its folded position, the spring is in tension.

24. The sofa-bed defined in claim 23, wherein, when the sofa-bed is in the unfolded position, the first, second and third pivots are generally aligned, with the first pivot being positioned below a longitudinal axis defined by the spring, thereby urging the sofa-bed to remain in the unfolded position.

25. The sofa-bed defined in claim 23, wherein the spring takes a first length when the sofa-bed is in the unfolded position and a second length when the sofa-bed is in the folded position, the second length being greater than the first length.

26. A sofa-bed, comprising:

a frame with opposing arms, the frame further comprising a back panel fixed to and extending between the arms;

a backrest operatively connected with the frame such that the backrest can pivot and slide relative to the frame;

a seat;

a subseat hinged to the seat and pivotable relative thereto at a first pivot; and a connecting member that pivotally interconnects the subseat and the backrest;

wherein the frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation; and wherein an upper edge of the back panel is positioned upwardly of an uppermost portion of the arms.

27. The sofa-bed defined in claim 26, wherein the back panel includes a recess, and wherein, in the folded position, the backrest fits within the recess.

28. The sofa-bed defined in claim 26, wherein the backrest, frame and back panel are configured such that, as the sofa-bed moves from the folded position to the unfolded position, the backrest is positioned forwardly of the back panel, thereby enabling the sofa-bed to move to the folded position without the need to position the sofa-bed such that a rearmost portion of the frame is spaced apart from an adjacent wall.

29. The sofa-bed defined in claim 28, wherein the connecting member directly interconnects the subseat and the backrest.

30. The sofa-bed defined in claim 28, wherein the backrest is includes an upper post that is slidable and pivotable within an upper slot in the frame arm and a lower post that is slidable and pivotable within a lower slot in the frame arm.

31. The sofa-bed defined in claim 30, wherein the upper slot defines a path having a rearwardmost portion, and wherein the lower path defines a path having a rearwardmost portion, and wherein the rearwardmost portion of the upper slot is positioned rearwardly of the rearwardmost portion of the lower slot.

32. The sofa-bed defined in claim 26, wherein the backrest has a cushion with a flap portion that unfolds from the cushion when the sofa-bed is in the folded position to provide a lumber support.

33. The sofa-bed defined in claim 31, wherein the backrest has a cushion that is devoid of a flap portion that unfolds from the cushion when the sofa-bed is in the unfolded position to provide a lumbar support.

34. A sofa-bed, comprising:

a frame with opposing arms;

a backrest operatively connected with the frame such that the backrest can pivot and slide relative to the frame, the backrest including a cushion that decreases in thickness from its forward end to its rearward end; a seat;

a subseat hinged to the seat and pivotable relative thereto at a first pivot; and a connecting member that pivotally interconnects the subseat and the backrest;

wherein the frame, backrest, seat and subseat are configured to move between a folded position, in which the backrest is generally upright, the seat is generally horizontal, and the subseat is generally horizontal and positioned beneath the seat in a first inverted orientation, and an unfolded position, in which the backrest, subseat and seat are generally horizontal, and the subseat is positioned between the backrest and the seat in a second non-inverted orientation; and wherein the frame includes a back panel with a recess, and wherein, in the folded position, the backrest fits within the recess.

* * * * *